US007438372B2

(12) United States Patent
Imai

(10) Patent No.: US 7,438,372 B2
(45) Date of Patent: Oct. 21, 2008

(54) DRIVER DEVICE FOR RECORDING HEAD

(75) Inventor: Koji Imai, Inuyama (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 414 days.

(21) Appl. No.: 10/998,107

(22) Filed: Nov. 24, 2004

(65) Prior Publication Data

US 2005/0110814 A1 May 26, 2005

(30) Foreign Application Priority Data

Nov. 25, 2003 (JP) ..... 2003-394343

(51) Int. Cl.
*B41J 29/38* (2006.01)

(52) U.S. Cl. ..... 347/10; 347/5

(58) Field of Classification Search ..... 347/5, 347/10–11, 15, 19

See application file for complete search history.

(56) References Cited

U.S. PATENT DOCUMENTS 6,604,817 B2 8/2003 Isono et al.
6,808,242 B2 * 10/2004 Kobayashi ..... 347/12
2003/0011653 A1 * 1/2003 Oikawa et al. ..... 347/15

FOREIGN PATENT DOCUMENTS

JP A-2001-158643 6/2000
JP A-2001-246744 9/2001

* cited by examiner

*Primary Examiner*—Julian D. Huffman
*Assistant Examiner*—Jason S Uhlenhake
(74) *Attorney, Agent, or Firm*—Reed Smith LLP

(57) ABSTRACT

There is disclosed a drive circuit of a driver device for a recording head of a recording apparatus, which receives a print data signal so as to drive each of a plurality of recording elements of the recording head in accordance with the print data signal. The print data signal including a selecting signal for selecting one of a plurality of waveform signals representing respective recording modes, and a non-selecting signal. The drive circuit comprises an outputting portion which outputs the selecting signal included in the print data signal, with the selecting signal associated with the corresponding recording element, and a non-selecting signal utilizing portion which uses the non-selecting signal for a purpose other than the selection of one of the waveform signals.

30 Claims, 17 Drawing Sheets

FIG.7(A)

| SIN2 | SIN1 | SIN0 | SELECTED WAVEFORM SIGNAL | |
|---|---|---|---|---|
| 0 | 0 | 0 | | NON-EJECTION |
| 0 | 0 | 1 | FIRE1 | SMALL VOLUME |
| 0 | 1 | 0 | FIRE2 | INTERMEDIATE VOLUME |
| 0 | 1 | 1 | FIRE3 | LARGE VOLUME |
| 1 | 0 | 0 | FIRE4 | SMALL VOLUME, HISTORICAL |
| 1 | 0 | 1 | FIRE5 | INTERMEDIATE VOLUME, HISTORICAL |
| 1 | 1 | 0 | FIRE6 | LARGE VOLUME, HISTORICAL |
| 1 | 1 | 1 | NOT ASSIGNED | USED FOR GENERATING STROBE SIGNAL |

FIG.7(B)

| SIN | SELECTED WAVEFORM SIGNAL | |
|---|---|---|
| 0 0 0 | | NON-EJECTION |
| 0 0 1 | FIRE1 | SMALL VOLUME |
| 0 1 0 | FIRE2 | INTERMEDIATE VOLUME |
| 0 1 1 | FIRE3 | LARGE VOLUME |
| 1 0 0 | FIRE4 | SMALL VOLUME, HISTORICAL |
| 1 0 1 | FIRE5 | INTERMEDIATE VOLUME, HISTORICAL |
| 1 1 0 | FIRE6 | LARGE VOLUME, HISTORICAL |
| 1 1 1 1 1 | NOT ASSIGNED | USED FOR GENERATING STROBE SIGNAL |

CLK
SIN[2..0]
S0-[2..0]
S1-[2..0]
S73-[2..0]
S74-[2..0]
STB
SEL0-[2..0]
SEL1-[2..0]
SEL73-[2..0]
SEL74-[2..0]
1
2
3
4
5
6
7
67
68
69
70
71
72
73
74
75
074
073
072
071
070
069
068
008
007
006
005
004
003
002
001
000
009
074
073
072
071
070
069
068
074
073
072
071
070
069
068
074
073
072
071
070
069
068

DRIVER DEVICE FOR RECORDING HEAD

The present application is based on Japanese Patent Application No. 2003-394343 filed on Nov. 25, 2003, the contents of which are incorporated herein by reference.

BACKGROUND OF THE INVENTION

1. Field of the Invention

The present invention relates to a driver device for a recording head, particularly to a driver device suitable for use in a recording head of an ink jet printer which is capable of ejecting an ink.

2. Discussion of Related Art

A color ink jet printer typically comprises an ink jet head where four nozzle rows for respective colors (for instance, yellow (Y), magenta (M), cyan (C), and black (Bk)) are formed. A piezoelectric element is disposed correspondingly to each of the nozzles, to apply a pressure to an ink of the respective color, to eject the ink from the nozzle. Each of the piezoelectric elements of the ink jet head is driven by an electric potential applied from a driver IC which is mounted on a carriage together with the ink jet head. The driver IC on the carriage and a main body of the ink jet printer are connected to each other via a signal cable such as a flexible wiring board.

Recently, an arrangement where plural kinds of waveform signals are supplied is employed, so that a printing with intensity gradation is enabled. There is also employed an arrangement where plural kinds of waveform signals are supplied so that a waveform of a signal used for ejection of an ink can be changed depending upon whether the ink has been or will be ejected at the immediately previous or subsequent ejecting timing, in order to reduce an influence of a residual vibration after an ink ejection, which arrangement may be called a historical control. In JP-A-2000-158643, there is disclosed an arrangement where such plural kinds of waveform signals are selectively applied to each of the piezoelectric elements.

A conventional driver IC for driving the piezoelectric elements will be described by referring to a diagram of FIG. 16 and a timing chart of FIG. 17.

As shown in FIG. 16, the driver IC 160 includes a shift register 162 as a serial-parallel converter, which converts print data serially transmitted from an external device, into parallel data for each nozzle. A delay flip-flop 164 latches the parallel data. A multiplexer 166 selects one of plural kinds of waveform signals which is designated by the print data for each nozzle, and outputs the selected waveform signal to a drive buffer 168 At last, the drive buffer 168 supplies the waveform signal, as a drive signal with a predetermined voltage, to a piezoelectric element corresponding to the nozzle.

There will be provided further detailed description of each element of the driver IC 160.

Into the shift register 162 is inputted print data of three bits SIN0, SIN1, SIN2 each serially transmitted in synchronization with a transmission clock signal CLK, from a circuit board in the main body of the printer. A bit length of the shift register 162 corresponds to a product of the number (e.g., 75) of nozzles in each nozzle row and the number of bits of the print data. As shown in FIG. 17, the shift register 162 converts the print data SIN0, SIN1, SIN2 into parallel data in accordance with rising edges of the transmission clock signal CLK, and outputs parallel print signal Sn-0, Sn-1, Sn-2 for each of the 75 nozzles, where "n" represents one of numbers 0-74. In the following description, too, n represents one of numbers 0-74.

The D flip-flop 164 outputs print signal Sn-0, Sn-1, Sn-2 as a selecting signal SELn-0, SELn-1, SELn-2, in accordance with rising edges of a strobe signal STB transmitted from the circuit board in the main body of the printer, as shown in FIG. 17. A bit length of the D flip-flop 164 is the same as that of the shift register 162.

The driver IC 160 receives waveform signals FIRE1, FIRE2, FIRE3, FIRE4, FIRE5, FIRE6 outputted from a waveform signal generating portion (not shown) in the circuit board in the main body, through respective signal lines. The waveform signals FIRE1-6 are inputted into the multiplexer 166.

The multiplexer 166 selects one of the waveform signals FIRE1-6, i.e., six print waveform signals, based on the selecting signal SELn-0, SELn-1, SELn-2 as outputted from the D flip-flop 164, and outputs the selected waveform signal as a waveform signal Bn.

The drive buffer 168 receives the waveform signal Bn outputted from the multiplexer 166, and supplies it as a drive signal OUTn with the predetermined voltage, to the piezoelectric element corresponding to the nozzle, so as to drive the piezoelectric element.

Further, the driver IC 160 comprises a temperature sensor 170 for measuring the temperature of the ink jet head and transmitting a temperature signal VTEMP of analog voltage to the circuit board in the main body, and a test signal transmitting portion 172 for outputting a test signal CHECK used for testing the driver device before shipping.

As described above, the driver IC is mounted on the ink jet head on the carriage. Therefore, the driver IC is connected to the circuit board in the main body of the ink jet printer, through a flexible printed circuit board (FPC), a flexible flat cable (FFC), or the like, which has a flexibility. Hence, with the increase in the number of the signal lines (FIRE1, FIRE2, FIRE3, FIRE4, FIRE5, FIRE6, SIN0, SIN1, SIN2, VTEMP, CHECK), the width of the cable increases. Accordingly, the conventional arrangement is vulnerable to disconnection of lines when a physical force is applied onto the cable, lowering the reliability. Further, with the increase in the number of nozzles, the pitch of leads of a connector connected to the driver IC, for instance, becomes small, making the structure complex. In addition, increase in the number of core wires of the flexible printed circuit board (FPC) or flexible flat cable (FFC) pushes up the required cost.

SUMMARY OF THE INVENTION

The present invention has been developed in view of the above-described situations, and an object of the invention is, therefore, to provide a driver device for a recording head, which requires a reduced number of signal lines connecting the driver device to the circuit board in the main body, and where the increase in the required cost and the degree of structural complexity is minimized.

To attain the above object, the invention provides a drive circuit of a driver device for a recording head of a recording apparatus, which receives a print data signal so as to drive each of a plurality of recording elements of the recording head in accordance with the print data signal, comprising: the print data signal including a selecting signal for selecting one of a plurality of waveform signals representing respective recording modes, and a non-selecting signal; an outputting portion which outputs the selecting signal included in the print data signal, with the selecting signal associated with the corresponding recording element; and a non-selecting signal utilizing portion which uses the non-selecting signal for a purpose other than the selection of one of the waveform signals.

According to the arrangement where the print data signal comprises the selecting signal used for selecting one of the waveform signals and the non-selecting signal serving for another purpose, the number of data signal lines required can be reduced, compared to an arrangement where a selecting signal for selecting one of waveform signals and the non-selecting signal serving for another purpose are separately transmitted through respective signal lines.

In a first preferred mode, the driver circuit further comprises a waveform selecting portion which selectively outputs the waveform signal to each recording element. The print data signal comprises a plurality of serial data signals, and the selecting signal designates one of the waveform signals by one of a plurality of combinations of plural bits each from a respective one of the serial data signals. The outputting portion outputs the selecting signal into the waveform selecting portion, the waveform selecting portion outputs, to each corresponding recording element, the waveform signal designated by the combination of plural bits of the selecting signal outputted from the outputting portion, and the non-selecting signal utilizing portion uses, as the non-selecting signal, at least one of the combinations of plural bits which is not used for the selection of one of the waveform signals.

According to the first mode, the plurality of waveform signals can be outputted from the waveform selecting portion to each recording element based on the respective combinations of plural bits of the print data signal comprising a plurality of serial data signals and outputted from the outputting portion, and the at least one combination which is not used for the selection of one of the waveform signals is used for other purposes than the selection between/among the waveform signals.

In a second preferred mode, the print data signal comprises a single serial data signal, and the selecting signal designates one of the waveform signals by one of a plurality of combinations of plural bits of the single serial data signal. The non-selecting signal utilizing portion uses, as the non-selecting signal, at least one of the combinations of plural bits which is not used for the selection of one of the waveform signals.

According to the second mode, the plurality of waveform signals can be outputted to each recording element based on the respective combinations of plural bits of the print data signal comprising the single serial data signal and outputted from the outputting portion, and the at least one combination which is not used for the selection of one of the waveform signals is used for other purposes than the selection between/among the waveform signals.

For instance, the at least one combination which is not used for the selection between/among the waveform signals is used for (i) generating a strobe signal or (ii) transmitting information from the driver device to a main body of the recording apparatus. When the at least one combination not used for the waveform signal selection is used for generating a strobe signal, a strobe signal line through which a strobe signal is transmitted from a main body of the recording apparatus to the driver device, can be omitted when the at least one combination is used for transmitting the information from the driver device to the main body, a signal line required for the transmission can be omitted.

Where the at least one combination not used for the wave form signal selection consists of a plurality of them, that is, where a plurality of combinations are left unused, a part or all of the unused combinations can be respectively used for a plurality of purposes different than the waveform signal selection. The plurality of purposes may include at least one of the above-indicated purposes (i) and (ii), or may not include any of them. In such a case where there are a plurality of combinations which are not used for the selection of one of the waveform signals but used for other purposes, respectively, the number of signal lines which can be omitted increases advantageously.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which:

FIG. 7(A) indicates correspondence between various waveform signals and combinations of plural bits of print data in the first embodiment, while FIG. 7(B) indicates that in a second embodiment;

DETAILED DESCRIPTION OF THE PREFERRED EMBODIMENTS

There will be described several embodiments of the invention by reference to the accompanying drawings.

First Embodiment

Figure 1:
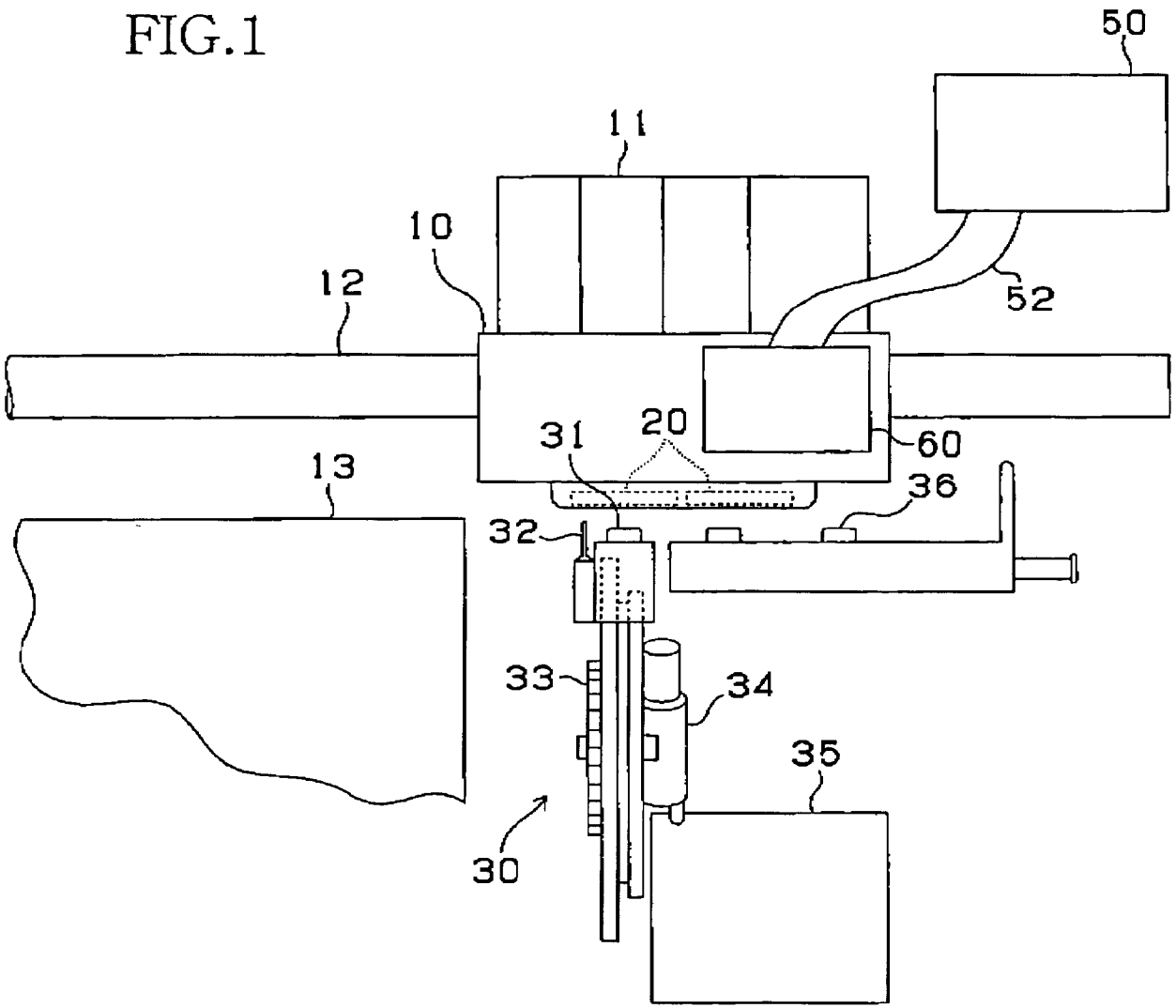
FIG. 1 is an explanatory view showing a structure of an ink jet printer according to a first embodiment of the invention.
Figure 2:
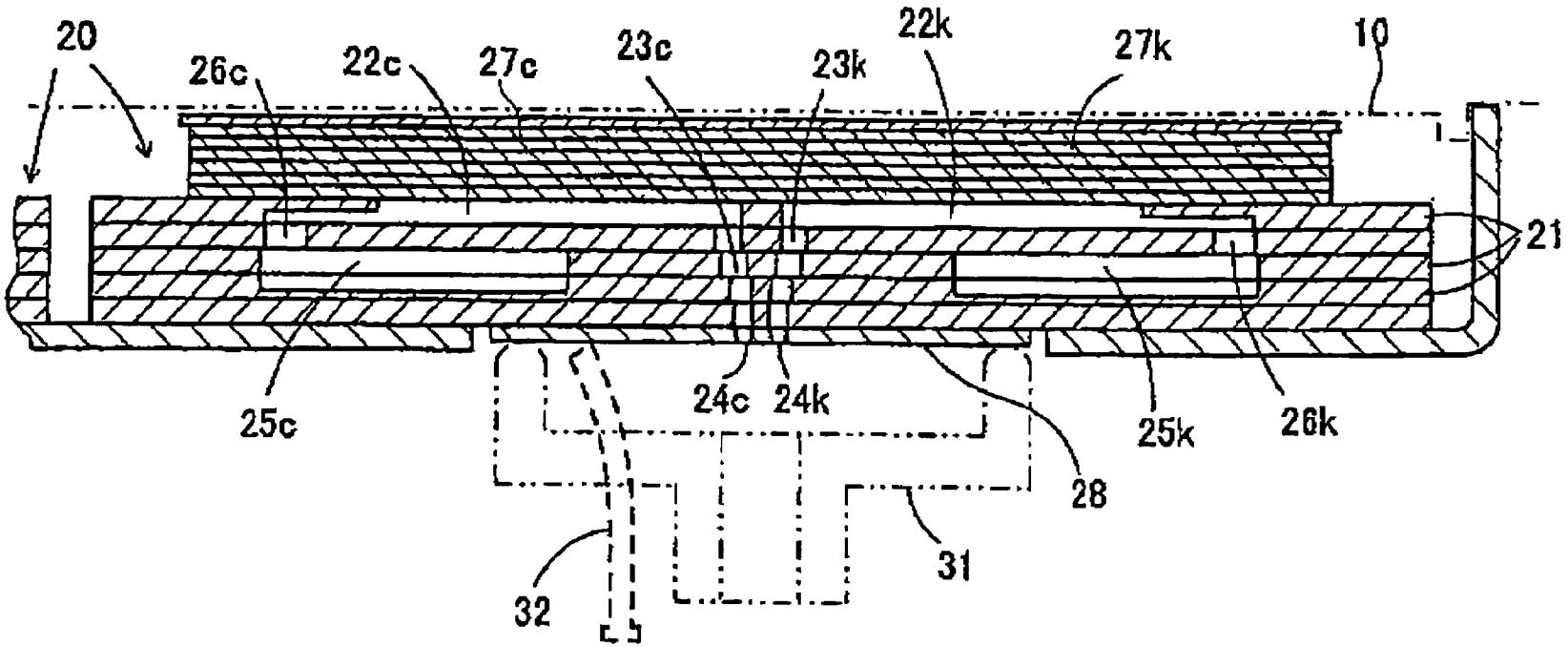
FIG. 2 is an explanatory view showing a structure of an ink jet recording head shown in FIG. 1.
Figure 3:
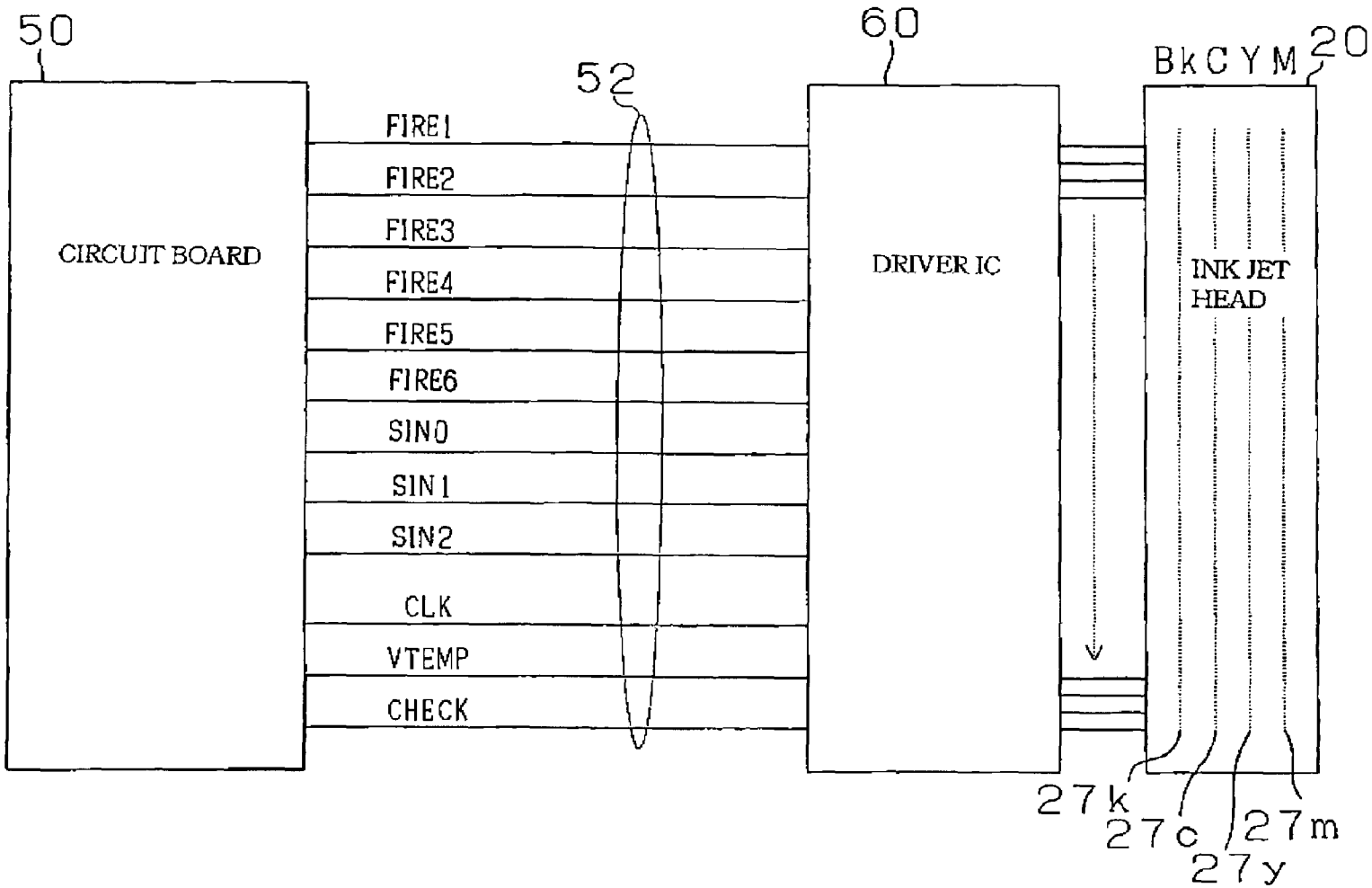
FIG. 3 is a block diagram showing a connection between a driver IC of the recording head and a circuit board in a main body of the recording apparatus.

Referring to FIGS. 1-3, there will be described an ink jet printer according to a first embodiment of the invention.

Two ink jet heads 20 are mounted on a carriage 10, as shown in FIG. 1, to be moved along a shaft 12 in parallel to a surface of a printing medium (printing paper) on a printing paper conveying portion 13, to eject droplets of ink onto the printing paper. On the carriage 10 are mounted four ink cartridges 11 incorporating inks of black, yellow, magenta, and cyan, respectively. The black ink and cyan ink are supplied to one of the two ink jet heads 20, while the yellow ink and magenta ink are supplied to the other ink jet head 20. As shown in FIG. 2, in a lower surface 28 (i.e., a nozzle surface) of the former ink jet head 20, a plurality of nozzles 24*k* for ejecting the black ink therethrough are formed in a row, and a plurality of nozzles 24*c* for ejecting the cyan ink therethrough are also formed in a row, the respective rows extending in the direction perpendicular to the surface of the sheet on which FIG. 1 is presented. Similarly, in the latter ink jet head 20, a row of nozzles for ejecting the yellow ink and a row of nozzles for ejecting the magenta ink are formed.

Each ink jet head 20 has a structure identical with that of an ink jet head disclosed in JP-A-2001-246744, corresponding to U.S. Pat. No. 6,604,817. That is, the ink supplied from each ink cartridge is distributed to relevant pressure generating chambers 22*k*, 22*c* for the respective nozzles, through a common ink chamber 25*k*, 25*c* for each nozzle row and first communication holes for the respective nozzles A pressure is applied to the ink in each pressure generating chamber 22*k*, 22*c* by the piezoelectric actuator 27*k* with respect to the black ink and the piezoelectric actuator 27*c* with respect to the cyan ink, which are made of a piezoelectric ceramic, so that the ink is ejected from the corresponding nozzle 24*k*, 24*c* through a second communication hole 23*k*, 23*c*, respectively. The chambers 25, 25*c*, 22*k*, 22*c* and communication holes 26*k*, 26*c*, 23*k*, 23*c* are respectively provided in the form of openings formed through respective metallic plate materials 21, and corresponding chambers and communication holes are in communication with one another when the metallic plate materials 21 are stacked and laminated. A plate material providing the nozzle surface 28 is formed of a synthetic resin (polyimide) and coated with a water repellent material.

In FIG. 1, reference numeral 30 denotes a maintenance device which is operated when a defective ejection has occurred, or periodically, to perform a restoring process for the ink jet heads 20. The restoring process is such that the carriage 10 is first displaced to a position off the printing paper conveying portion 13, and then a suction cap 31 is moved toward one of the ink jet heads 20 with an action of a cam 33, to be eventually brought into close contact with the nozzle surface 28 to cover the nozzles 24*k*, 24*c*. Then, a suction pump 34 is driven to suck the ink within the nozzles 24*k*, 24*c* formed in two rows, at a time through the suction cap 31. The sucked ink is discharged to a waste ink tank 35, Thereafter, the suction cap 31 is moved away from the nozzle surface 28. When it is necessary to perform the restoring process for the nozzles of the yellow and magenta inks, the carriage 10 is moved to the position where the nozzles of the yellow and magenta inks are opposed to the suction cap 31, and then the same action as described above is repeated. Then, a wiper 32 is moved to a position near the ink jet head 20 with an action of the cam 33, and then the carriage 10 is moved along the shaft 12. This makes the wiper 32 wipe, in the lateral direction as seen in FIG. 1, both the nozzle surface 28 where the nozzles 24*k*, 24*c* of the black and cyan inks are open, and the nozzle surface 28 where nozzles of the yellow and magenta inks are open. When an operation of the ink jet printer is terminated, the carriage 10 is moved to a position where the two ink jet heads 20 are respectively opposed to a conservation cap 36, so that all the nozzles are covered by the conservation cap 36.

FIG. 3 shows an electrical block diagram of the ink jet printer.

A driver IC 60 for applying an electric potential to each of the piezoelectric actuators 27*k*, 27*c*, 27*y*, 27*m* for the black, cyan, yellow and magenta inks in the ink jet heads 20 are connected to a circuit board 50 in a main body of the ink jet printer via a flexible wiring board or signal cable 52. As shown in FIG. 1, the driver IC 60 is mounted on the ink jet heads 20, while the circuit board 50 is disposed on a stationary part in the ink jet printer. In the flexible wiring board 52, signal lines (FIRE1, FIRE2, FIRE3, FIRE4, FIRE5, FIRE6, SIN0, SIN1, SIN2, VTEMP, CHECK) as will be described later, and a ground wire and a power wire which are not shown, are included.

Each of the piezoelectric actuators 27*k* for the black ink, the piezoelectric actuators 27*c* for the cyan ink, the piezoelectric actuators 27*y* for the yellow ink, and the piezoelectric actuators 27*m* for the magenta ink, consists of 75 of them. As the actuator, there may be employed a diaphragm driven by a heater or static electricity, instead of the above-described one. In the ink jet printer, the nozzles, and ink passages and the actuators corresponding to the nozzles, constitute a recording element.

The preset invention is applicable not only to an ink jet printer but also to a printer employing a dot matrix method, such as a thermal transfer printer and a dot impact printer.

There will be described the driver IC 60 for driving the piezoelectric actuators, by referring to a circuit diagram of FIG. 4 and a timing chart of FIG. 5.

Figure 4:
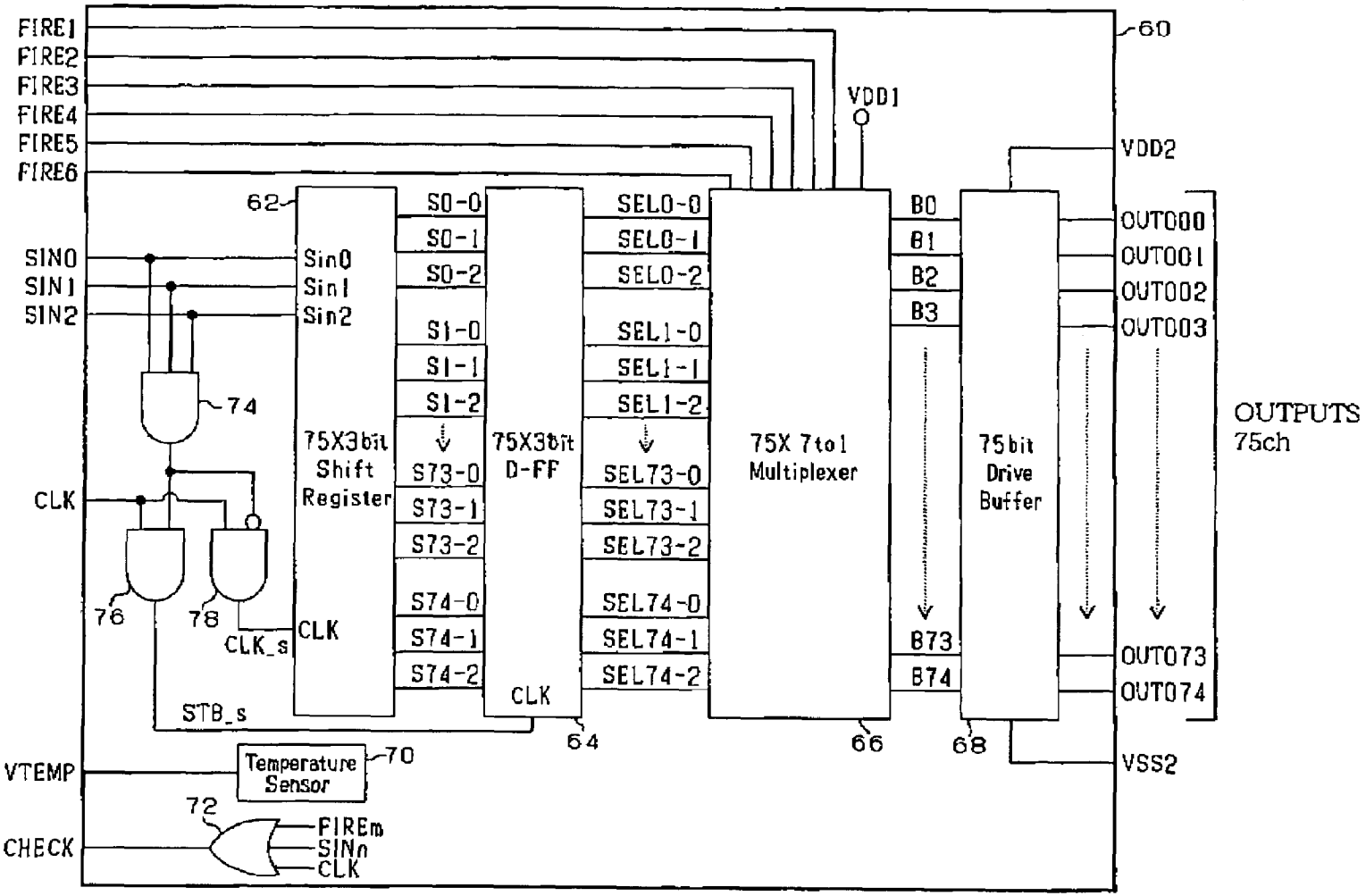
FIG. 4 is a circuit diagram of the driver IC shown in FIG. 3.
Figure 5:
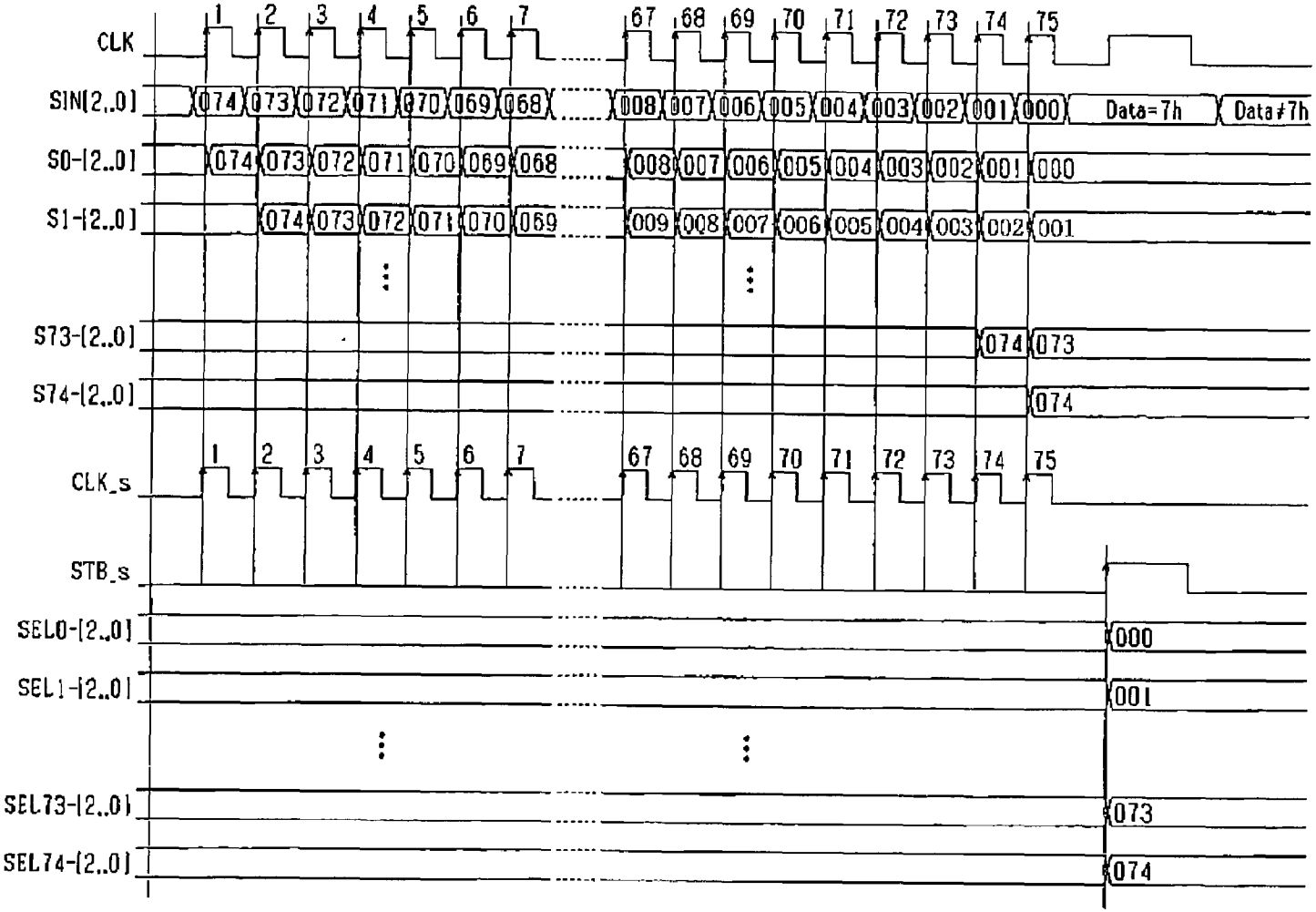
FIG. 5 is a timing chart illustrating signals treated in the driver IC.

As shown in FIG. 4, the driver IC 60 comprises a shift register 62 as a serial-parallel converter, a D flip-flop 64, a multiplexer 66 and a drive buffer 68. The shift register 62 converts serially incoming print data into parallel print data for each nozzle. The D flip-flop latches this parallel print data. The multiplexer 66 selects one of a plurality of waveform signals, which corresponds to the parallel print data. At last, the drive buffer 68 receives the waveform signal outputted from the multiplexer 66, and outputs it as a drive signal with a predetermined voltage, to a piezoelectric actuator of interest, A combination of the shift register 62 and D flip-flop 64 constitutes an outputting portion, while the multiplexer 66 constitutes a waveform selecting portion.

There will be provided further detailed description of each element of the driver IC 60.

The print data is data of three bits SIN0, SIN1, SIN2, and is inputted into the shift register 62 from the circuit board 50 in the main body, in synchronization with a transmission clock signal CLK. A bit length of the shift register 62 corresponds to a product of the number of nozzles in each nozzle row, i.e. 75, and the number of bits of the print data, and converts the print data SIN0, SIN1, SIN2 into parallel data at the timing of the rising edges of the transmission clock signal CLK, so that 75 parallel data Sn-0, Sn-1, Sn-2 for the respective nozzles are outputted. "n" represents one of numbers 0-74, and the same applies in the following description.

The D flip-flop 64 outputs the parallel print signal Sn-0, Sn-1, Sn-2 as selecting signals SELn-0, SELn-1, SELn-2 in accordance with a strobe signal STB generated based on the serial print data SIN0, SIN1, SIN2, as will be described later. A bit length of the D flip-flop 64 is the same as that of the shift register 62.

The driver IC 60 receives the waveform signals FIRE1, FIRE2, FIRES, FIRE4, FIRE5, FIRE6 outputted from a waveform signal generating portion (not shown) in the circuit board 50 in the main body, through respective signal lines. More specifically, the waveform signals FIRE1-FIRE6 are inputted into the multiplexer 66.

The multiplexer 66 selects one of the six waveform signals FIRE1-FIRE6, i.e., one of six print waveform signals, based on the selecting signals SELn-0, SELn-1, SELn-2 outputted from the D flip-flop 64, and outputs the selected one as a waveform signal Bn.

The drive buffer 68 receives the waveform signal Bn outputted from the multiplexer 66, and supplies it as a drive signal OUTn with a predetermined voltage, to 75 piezoelectric actuators 27*k* for the black ink corresponding to the nozzle row, to drive the piezoelectric actuators 27*k*.

The driver IC 60 further comprises a temperature sensor 70 for measuring a temperature of the ink jet heads 20 and transmitting a temperature signal VTEMP of analog voltage representative of the temperature to the circuit board in the main body, and a performance-testing-signal transmitting portion 72 for outputting a performance testing signal CHECK used for an operation test of the driver device before shipping. The performance-testing-signal transmitting portion 72 comprises an OR circuit, and returns a signal inputted into the driver IC 60 without processing the signals at all. For instance, the waveform signals FIRE1-FIRE6 are returned without being processed. By this arrangement, it can be checked whether the circuit board 50 in the main body and the driver IC 60 are properly connected via the flexible wiring board 52, after manufacturing and before shipping of the ink jet printer. It is noted that the temperature of the ink jet heads 20 includes at least one of a temperature of the piezoelectric actuators and a temperature of the driver IC 60.

In FIG. 4, merely the shift register 62, D flip-flop 64, multiplexer 66 and drive buffer 68 for one of four colors, namely, for the piezoelectric actuators 27*k* for the black ink, are shown for the sake of convenience. Actually, however, a shift register, a D flip-flop, a multiplexer and a drive buffer are provided for each of respective rows of the piezoelectric actuators 27*c* for the cyan ink, the piezoelectric actuators 27*y* for the yellow ink, and the piezoelectric actuators 27*m* for the magenta ink, so that the ejected volume of the inks of all of black, cyan, yellow and magenta colors are controllable based on respective print data SIN0, SIN1, SIN2.

Figure 6:
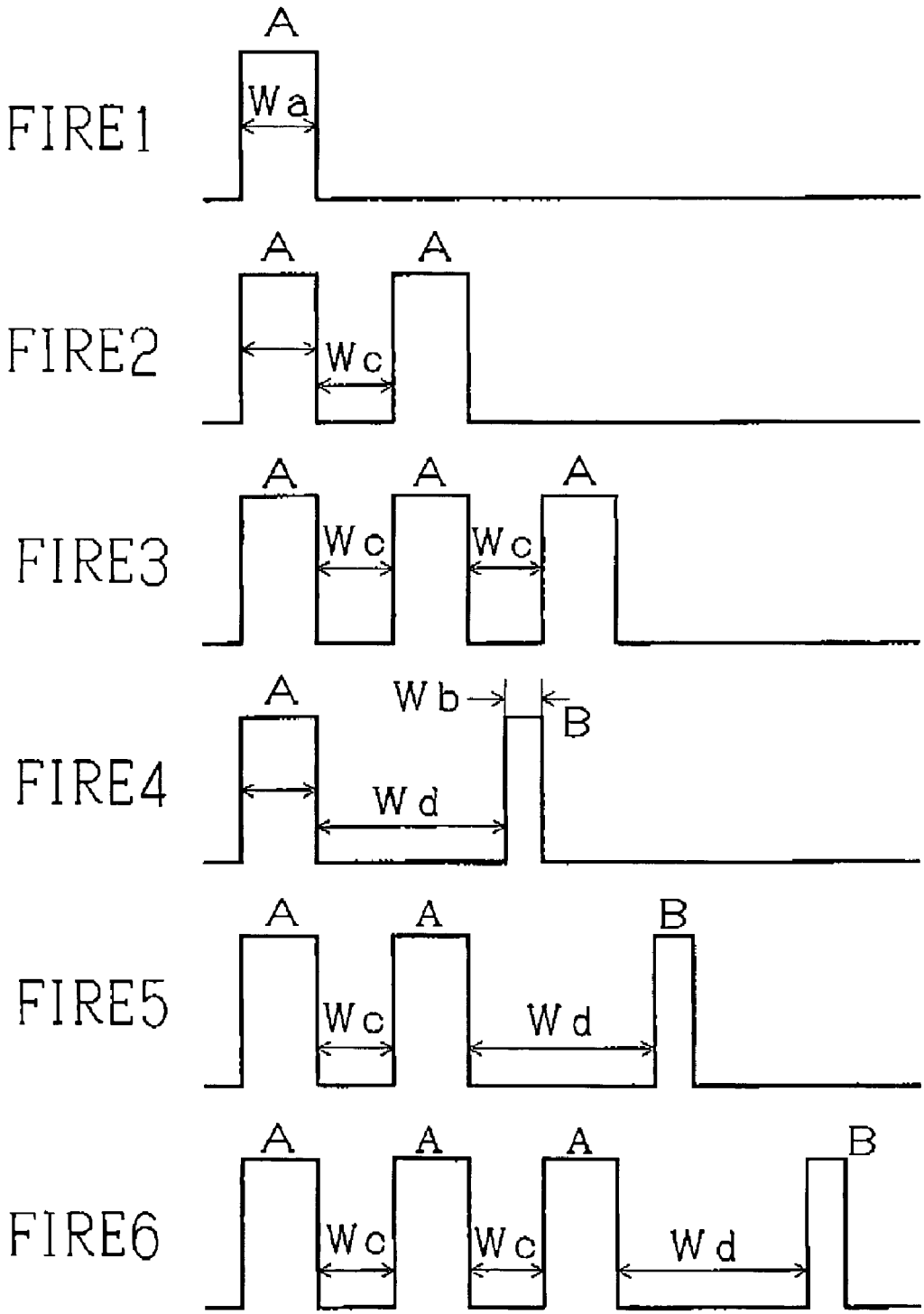
FIG. 6 is a timing chart illustrating an example of variation in the number and width of pulses of a waveform signal which defines a characteristic of ink ejection, in the driver IC illustrated in FIG. 4.

FIG. 6 is a timing chart of the waveform signals FIRE1-FIRE6, and FIG. 7(A) shows the waveform signals selected based on the combinations of the values of the three bits of the print data SIN0, SIN1, SIN2.

In the first embodiment, the waveform signals FIRE1, FIRE2, FIRE3 have respective waveforms which are different from one another in the number of ejection pulses A per data for one dot, as shown in FIG. 6, so as to accordingly differentiate the ink volume ejected on the surface of the paper. The waveform signals FIRE4, FIRE5, FIRE6 have respective waveforms where one or more redundant pulses B is added after the ejection pulse(s) A, so as to reduce a residual pressure-wave vibration in the pressure generating chamber 22*k*, 22*c*.

In the present embodiment, one of the six waveform signals FIRE1-FIRE6 or "non-ejection" is selected based on the three bits SELn-0, SELn-1, SELn-2 of the selecting signal respectively corresponding to the three bits SIN0, SIN1, SIN2 of the print data, as shown in FIG. 7(A). A combination SIN0(1), SIN1(1), SIN2(1) of the values of the three bits of the print data is not assigned to select any of the waveform signals FIRE1-FIRE6 or "non-ejection", but is used for generating a strobe signal, as will be described later. It is noted that the signal indicative of "non-ejection" is included in the "waveform signals" in a broad sense.

The generation of the strobe signal will be described, by referring back to FIG. 4.

An input line for each of three bits SIN0, SIN1, SIN2 of the print data is connected to a respective one of three input channels of a first AND circuit 74. An output of the first AND circuit 74 is connected to one of two inputs of a second AND circuit 76, and also to a negative logic input as one of two inputs of a third AND circuit 78. A clock signal CLK is inputted into the second AND circuit 76 and the other input of the third AND circuit 78. An output of the second AND circuit 76 is inputted into the D flip-flop 64, as a strobe signal STB_s, while an output of the third AND circuit 78 is inputted into the shift register 62, as a clock signal CLK_s. The first, second and third AND circuits 74, 76, 78 constitute a signal generating portion.

When there is inputted the combination SIN0(1), SIN1(1), SIN2(1) of the values of the three bits of the print data, which is not assigned to select any of the waveform or "non-ejection" signals, as described above, the output of the first AND circuit 74 is at the low level and inputted into the negative logic input of the third AND circuit 78. Accordingly, the third AND circuit 78 outputs the inputted clock signal CLK_s, to the shift register 62, as the clock signal CLK_s. In accordance with this clock signal CLK_s, the shift register 62 sequentially shifts the print data SIN0, SIN1, SIN2 in parallel.

On the other hand, when the combinations of the values of the three bits of the print data other than the combination SIN0(1), SIN1(1), SIN2(1) are inputted, the output of the first AND circuit 74 is at the high level and inputted into the one of the inputs of the second AND circuit 76. At the timing when the clock signal CLK_s is inputted, the output of the second AND circuit 76 becomes high at its level, and applied to the D flip-flop 64, as the strobe signal STB_s. Accordingly, the D flip-flop 64 receives the print signal Sn-0, Sn-1, Sn-2 from the shift register 62 and outputs it as the selecting signal SELn-0, SELn-1, SELn-2, as shown in FIG. 5.

In the first embodiment, the waveform signals FIRE1-FIRE6 are outputted in every printing cycle, constantly and repeatedly, and serve as an ejection timing signal in itself. That is, as described above, the print data outputted in parallel from the shift register into the D flip-flop 64 in accordance with the clock signal CLK, is then outputted from the D flip-flop 64 into the multiplexer 66 at the timing of the strobe signal STB_s generated based on the combination SIN0(1), SIN1(1), SIN2(1) of the values of the three bits of the print data which is not assigned to select any of the waveform or non-ejection signals. The multiplexer 66 selects one of the waveform signals FIRE1-FIRE6 which corresponds to the combination of the values of the three bits of the print data, and outputs the selected waveform signal to the drive buffer 68, as a waveform signal Bn, so that the ink in the volume corresponding to the print data is ejected from the nozzle.

As described above by reference to FIG. 7(A), in the first embodiment, seven of the eight combinations of the values of the three bits SIN0, SIN1, SIN2 of the print data are used for selecting the non-ejection signal or one of the six waveform signals FIRE1-FIRE6, and the remaining combination, which is not assigned to select any of the non-ejection or waveform signals and is predetermined to be SIN0(1), SIN1(1), SIN2(1), is used for generating the strobe signal STB_s. Thus, a strobe signal line included in the flexible wiring board 52 can be omitted from the flexible wiring board 52, by utilizing the signal lines, which are essentially for transmission of the print data, for transmission of data necessary for generating the strobe signal, also. Hence, the width of the flexible wiring board 52 is decreased, reducing the possibility of an occurrence of a disconnection even when an undesirable physical force is applied onto the flexible wiring board 52, and thereby improving the reliability. Further, the number of pins connected to the flexible wiring board 52 is reduced, widening the pitch of the pins of the connector, for instance, and accordingly simplifying the structure. Still further, since the number of core wires of the flexible printed circuit board (FPC) or flexible flat cable (FFC) is decreased, the manufacturing cost of the ink jet printer can be reduced.

Modification of the First Embodiment

There will be described an ink jet printer according to a modification of the first embodiment. The structure of the modification is identical with that of the first embodiment described above with reference to FIGS. 1-3, except the circuit configuration of the driver IC 60. Therefore, description of the identical part is omitted, by reference to FIGS. 1-3.

Figure 8:
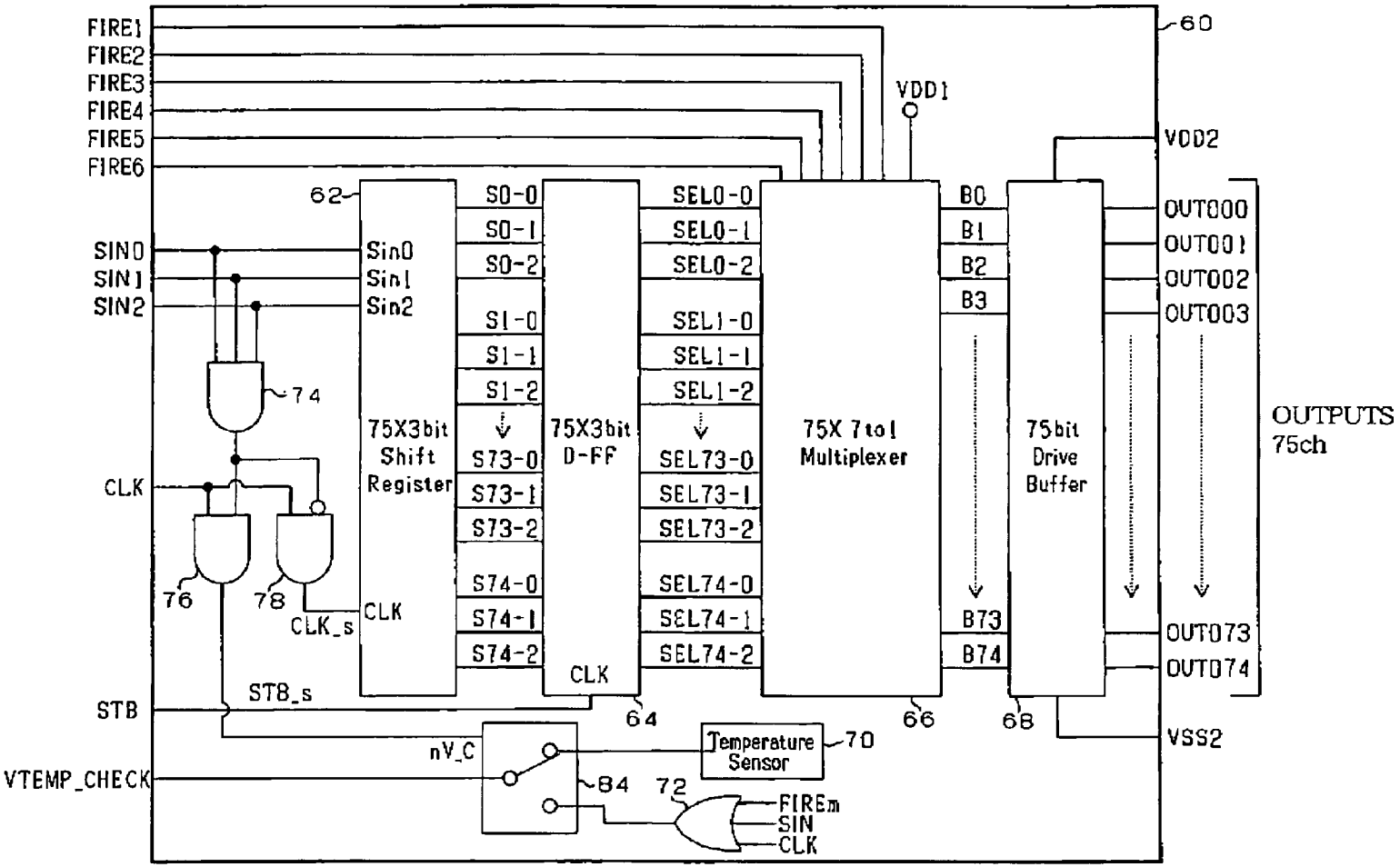
FIG. 8 is a circuit diagram of a driver IC according to a modification of the first embodiment.

FIG. 8 shows a circuit configuration of the driver IC 60 of the ink jet printer according to the modification of the first embodiment.

A structure of each of a shift register 62, D flip-flip 64, multiplexer 66 and drive buffer 68 shown in FIG. 8 is identical with the corresponding element in the first embodiment described above with reference to FIG. 4. Further, the structures of first and third AND circuits 74, 78 are also identical with the corresponding circuits in the first embodiment, too Namely, when one of combinations of the values of the three bits of the print data which are assigned to the selection among non-ejection and waveform signals, that is, combinations other than the combination SIN0(1), SIN1(1), SIN2(1), is inputted, the output of the first AND circuit 74 is at the low level and is inputted into the negative logic input of the third AND circuit 78. Accordingly, the third AND circuit 78 outputs the inputted clock signal CLK, to the shift register 62, as the clock signal CLK_s. In accordance with the clock signal CLK_s, the shift register 62 sequentially shifts the bits SIN0, SIN1, SIN2 of the print data in parallel.

In the modification of the first embodiment, a switch 84 for selection between outputs from the temperature sensor 70 and the performance-testing-signal transmitting portion 72 is further provided. Namely, one of the two outputs is selected by switching the switch 84 in response to the output from the second AND circuit 76. More specifically, when the combination SIN0(1), SIN1(1), SIN2(1) of the values of the three bits of the print data, which is not assigned to select any of the non-ejection or waveform signals is inputted, the output of the first AND circuit 74 is at the high level and inputted into the input of the second AND circuit 76. At the timing when the clock signal CLK is inputted, the output of the second AND circuit 76 becomes high in its level, and is inputted into the switch 84. The switch 84 operates to select one of the inputs from the temperature sensor 70 and from the performance-testing-signal transmitting portion, and outputs the selected one. The switch 84 constitutes an information output portion.

In the modification of the first embodiment, it is configured such that when the combination SIN0(1), SIN1(1), SIN2(1) of the values of the three bits of the print data is inputted, the switch 84 outputs the output from the performance-testing-signal transmitting portion 72 to the circuit board 50 in the main body (shown in FIG. 3), and the waveform signals FIRE1-FIRE6, print data SIN0, SIN1, SIN2, and clock signal CLK are sequentially applied to the driver IC 60, so as to check whether these signals as the performance testing signal CHECK can be properly returned to the circuit board 50. Thus, an operation check, i.e., whether the flexible wiring board 52 is properly connected, and accordingly, whether the circuit board 50 and the driver IC 60 are properly connected to each other via the flexible wiring board 52, is performed.

It is configured such that the switch 84 normally outputs the output from the temperature sensor 70 representing a temperature, i.e., a value of analog voltage corresponding to the temperature of the ink jet heads, As described with reference to FIG. 7(A), seven of eight combinations of the values of the three bits SIN0, SIN1, SIN2 of the print data are used for selecting one of the waveform signals FIRE1-FIRE6 or "non-ejection", while the remaining one is used for selecting one of the outputs from the temperature sensor 70 and the performance-testing-signal transmitting portion 72. This enables to switch between a plurality of sources of respective pieces of information, namely, between the temperature sensor 70 and the performance testing-signal transmitting portion 72, based on the print data signal. Since an output signal line for the signal representing the temperature and an output signal line for the performance testing signal can be integrated into a single signal line, it is made possible to omit from the flexible wiring board 52 the signal line for the performance testing signal or for transmitting performance testing information, which is not necessary during the printer is actually used. The omission of the signal line for transmitting the performance testing information from the flexible wiring board 52 decreases the number of the signal lines in the flexible wiring board 52, or the width of the flexible wiring board 52, thereby reducing the possibility of an occurrence of a disconnection even when an undesirable physical force is applied onto the flexible wiring board 52. Thus, the reliability is improved. Further, the number of pins connected to the flexible wiring board 52 decreases, widening the pitch of the connector, for instance, and thereby simplifying the structure. Still further, the reduction in the number of core wires of the flexible printed circuit board (FPC) or the flexible flat cable (FFC) can reduce the manufacturing cost of the ink jet printer.

Second Embodiment

There will be described an ink jet printer according to a second embodiment of the invention. A structure of the ink jet printer of the second embodiment is identical with that of the first embodiment as described above with reference to FIGS. 1-3, except the circuit configuration of the driver IC 60. Therefore, description of the identical part of the second embodiment is omitted, by reference to FIGS. 1-3.

Figure 9:
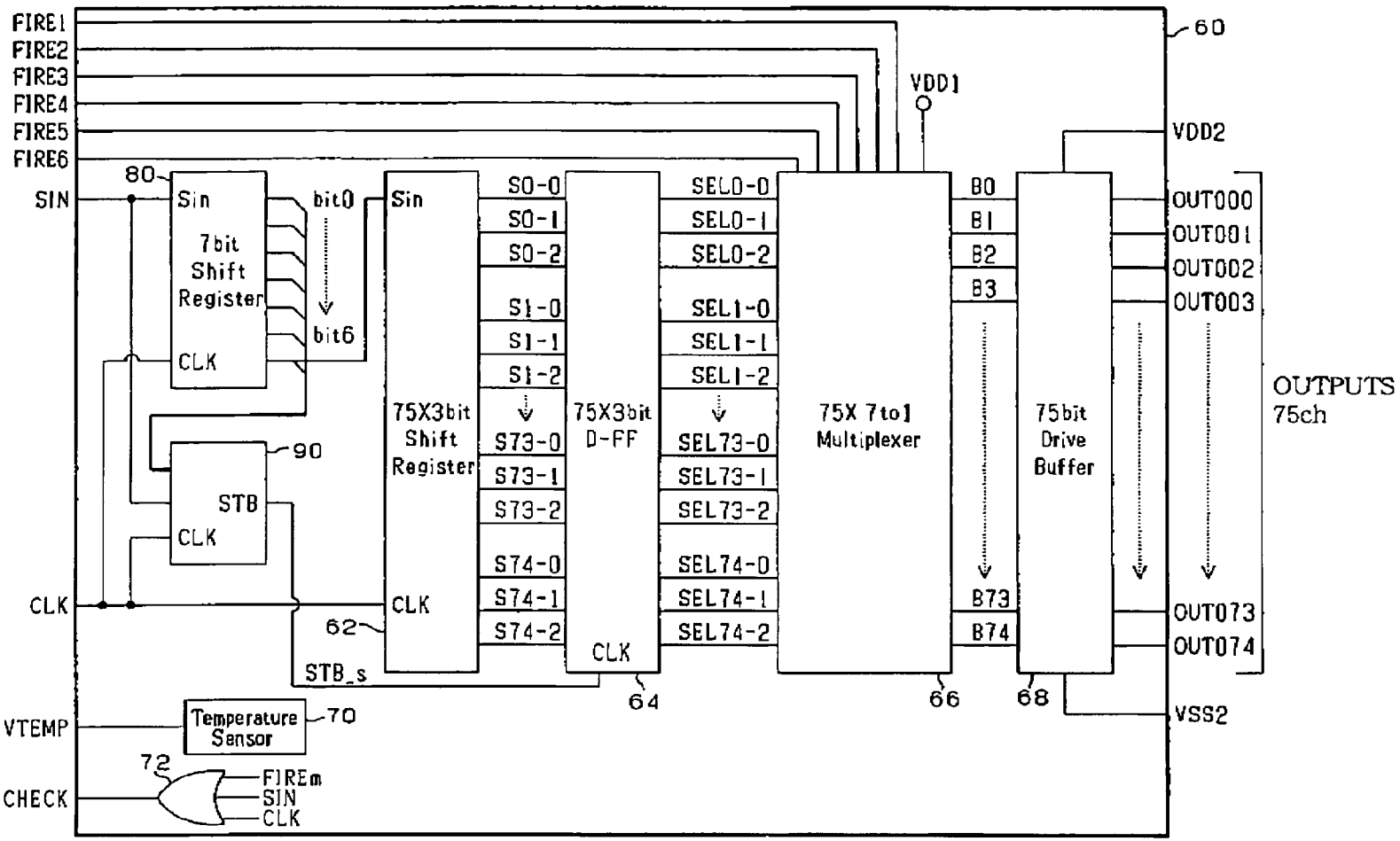
FIG. 9 is a circuit diagram of a driver IC according to a second embodiment of the invention.
Figure 10:
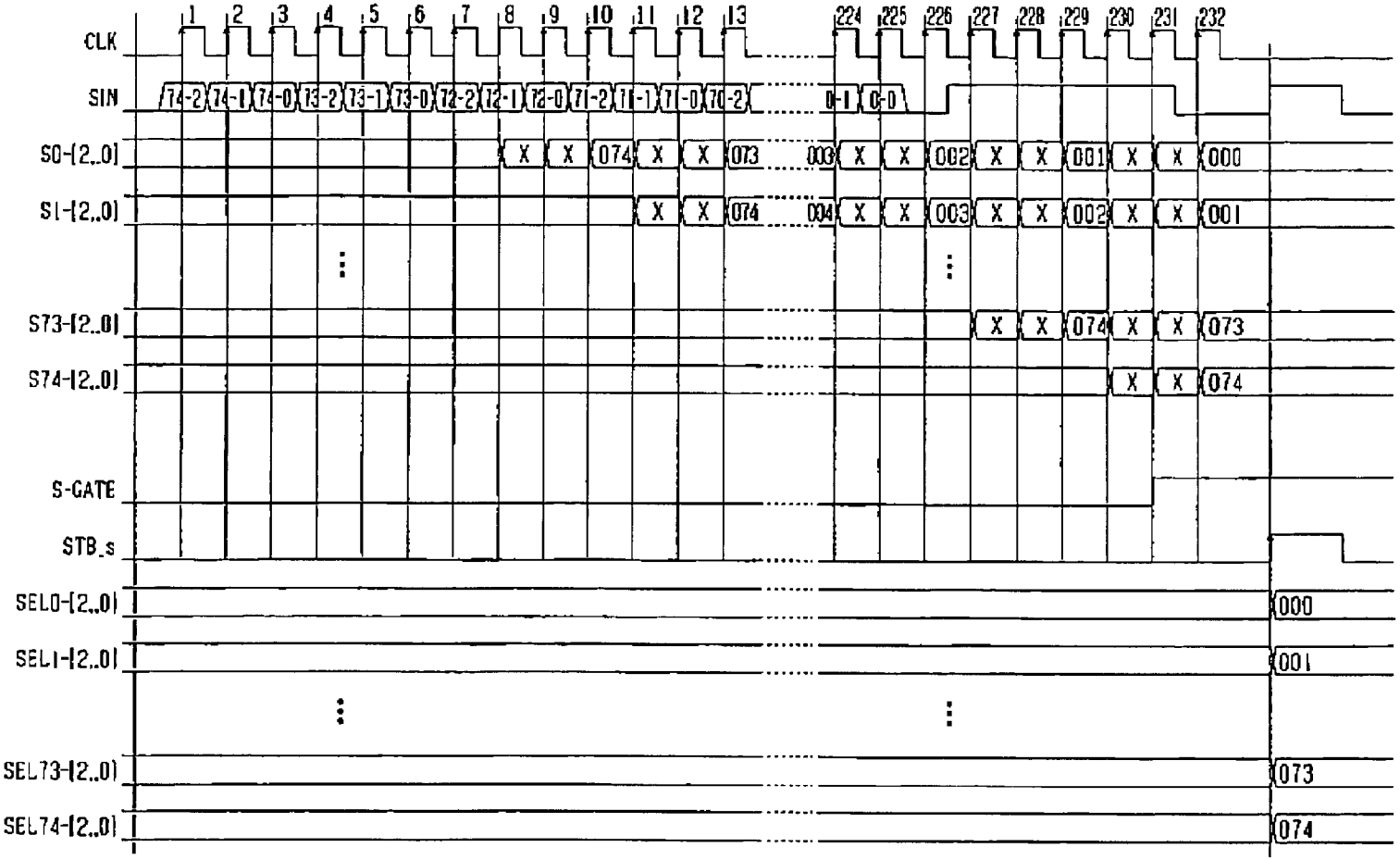
FIG. 10 is a timing chart illustrating signals treated in the driver IC of the second embodiment.

FIG. 9 shows a circuit configuration of the driver IC 60 of the ink jet printer according to the second embodiment, while FIG. 10 is a timing chart illustrating signals treated in the driver IC.

The structures of a D flip-flip 64, multiplexer 66, and drive buffer 68 are identical with that of the corresponding elements in the first embodiment described above by referring to FIG. 4. In the first embodiment, the print data of the three bits SIN0, SIN1, SIN2 which is transmitted through the three signal lines is employed as the print data. However, in the second embodiment, print data SIN which is transmitted through a single signal line is employed. A bit length of the shift register 62 corresponds to a product of the number of nozzles in each nozzle row (i.e., 75) and the number of bits, i.e., one in the present embodiment, of print data. The shift register 62 converts the print data SIN into parallel data Sn-0, Sn-1, Sn-2 for each of the 75 nozzles (where "n" represents one of numbers 0-74), in accordance with the rising edges of the transmission clock signal CLK, and outputs the parallel data.

Figure 11:
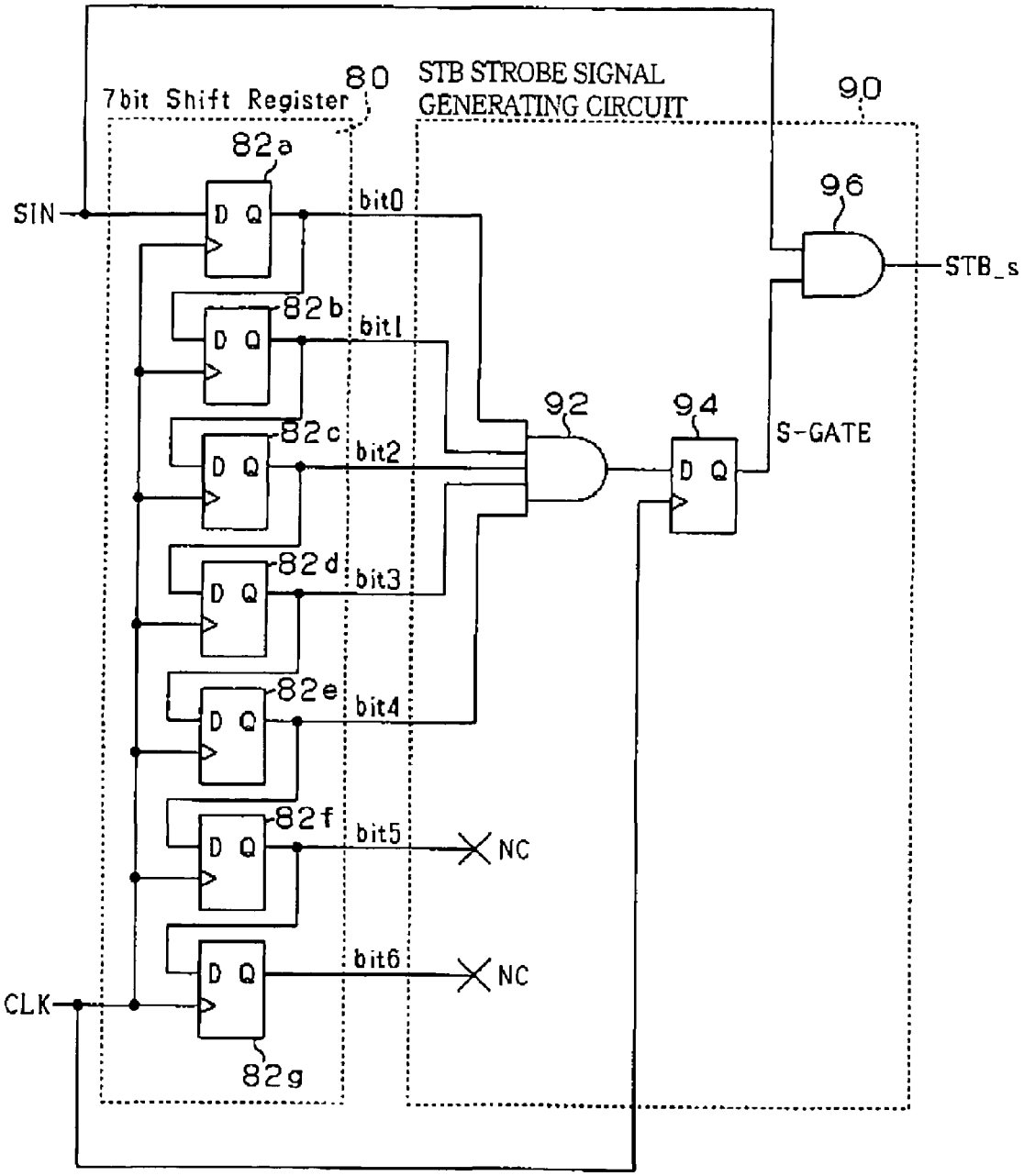
FIG. 11 is a circuit diagram showing a part of the driver IC, namely, a 7-bit shift register and a strobe signal generating portion, of the second embodiment.

In the path of the print data in the driver IC 60, a 7-bit shift register 80 precedes the shift register 62. A strobe signal generating circuit 90 for generating a strobe signal is connected to the 7-bit shift register 80. FIG. 11 shows the configuration of a part of the driver IC 60 including the 7-bit shift register 80 and the strobe signal generating circuit 90 as shown in FIG. 9.

The 7-bit shift register 80 consists of seven D flip-flops 82*a*, 82*b*, 82*c*, 82*d*, 82*e*, 82*f*, 82*g* for holding a total of seven bits of data. The strobe signal generating circuit 90 comprises a fourth AND circuit 92 with five inputs, a D flip-flop 94, and a fifth AND circuit 96 with two inputs. The outputs of five 82*a*, 82*b*, 82*c*, 82*d*, 82*e* of the seven D flip-flops are inputted into the fourth AND circuit 92, while the outputs of the remaining two D flip-flops 82*f*, 82*g* are not connected to anywhere and are released D That is, when the levels of consecutive five bits of the print data registered in five 82*a*, 82*b*, 82*c*, 82*d*, 82*e* of the seven D flip-flops are all high, namely, when print data SIN(11111) is inputted, the output of the fourth AND circuit 92 is at the high level, and applied to one of the two inputs of the D flip-flop 94. At the timing when the clock signal CLK is applied to the other of the two inputs, the D flip-flop 94 outputs a strobe gate signal S-GATE to the input of the fifth AND circuit 96. With the strobe gate signal S-GATE inputted therein, the fifth AND circuit 96 outputs the strobe signal STB_s at the timing when the print data SIN is applied to the other input of the fifth AND circuit 96. The strobe signal STB_s is outputted to the D flip-flop 64 in the similar way as described with respect to the first embodiment with reference to FIG. 4. Thus, the D flip-flop 64 receives the print signal Sn-0, Sn-1, Sn-2 from the shift register 62, and outputs it as selecting signal SELn-0, SEL-1, SELn-2, as shown in FIG. 10.

Correspondence between the print data and waveform signals in the ink jet printer of the second embodiment is shown in FIG. 7(B). Pulse waves of the respective waveform signals FIRE1-FIRE6, which are subjected to a selection in accordance with the print data SIN, is identical with that in the first embodiment described with reference to FIG. 6. Further, correspondence between the print data and the waveform signals FIRE1-FIRE6 or "non-ejection" is the same as that in the first embodiment as described above by reference to FIG. 7(A).

That is, a combination SIN(000) of the values of three serial bits of the print data is for selecting "non-ejection", while the combinations SIN(001), SIN(010), SIN(011), SIN (100), SIN(101), SIN(110) of the values of three serial bits of the print data are respectively for selecting the waveform signals FIRE1, FIRE2, FIRE3, FIRE4, FIRES, FIRE6. In the second embodiment, it is arranged such that the strobe signal is generated based on the print data SIN(11111), in view of the following fact: When the print data SIN(011) designating the waveform signal FIRE3 and the print data SIN(110) designating the waveform signal FIRE6 are serially and in succession transmitted, there occurs a state where four consecutive bits of the serial data SIN are at the high level, namely, a sequence (011110) occurs. Hence, the strobe signal is generated based on the print data SIN(11111) (five bits at the high level) which does not occur when the print data for selecting the waveform (or non-ejection) signals are sequentially inputted in succession.

As described above with reference to FIG. 7(B), in the second embodiment, the strobe signal line included in the flexible wiring board 52 is omitted, by arranging such that the strobe signal is generated based on the combination or sequence of bits (11111) of the print data SIN, which does not occur when print data for selecting one of the waveform or non-ejection signals are sequentially and in succession inputted. This arrangement decreases the width of the flexible wiring board 52, reducing the possibility of an occurrence of a disconnection even when an undesirable physical force is applied onto the flexible wiring board 52. Thus, the reliability is improved. Further, the number of pins connected to the flexible wiring board 52 is reduced, widening the pitch of the pins of the connector, for instance, and accordingly simplifying the structure. Further, since the number of core wires of the flexible printed circuit board (FPC) or flexible flat cable (FFC) is decreased, the manufacturing cost of the ink jet printer can be reduced.

Modification of the Second Embodiment

There will be described an ink jet printer according to a modification of the second embodiment, whose structure is identical with that of the first embodiment, except the circuit configuration of the driver IC 60.

Figure 12:
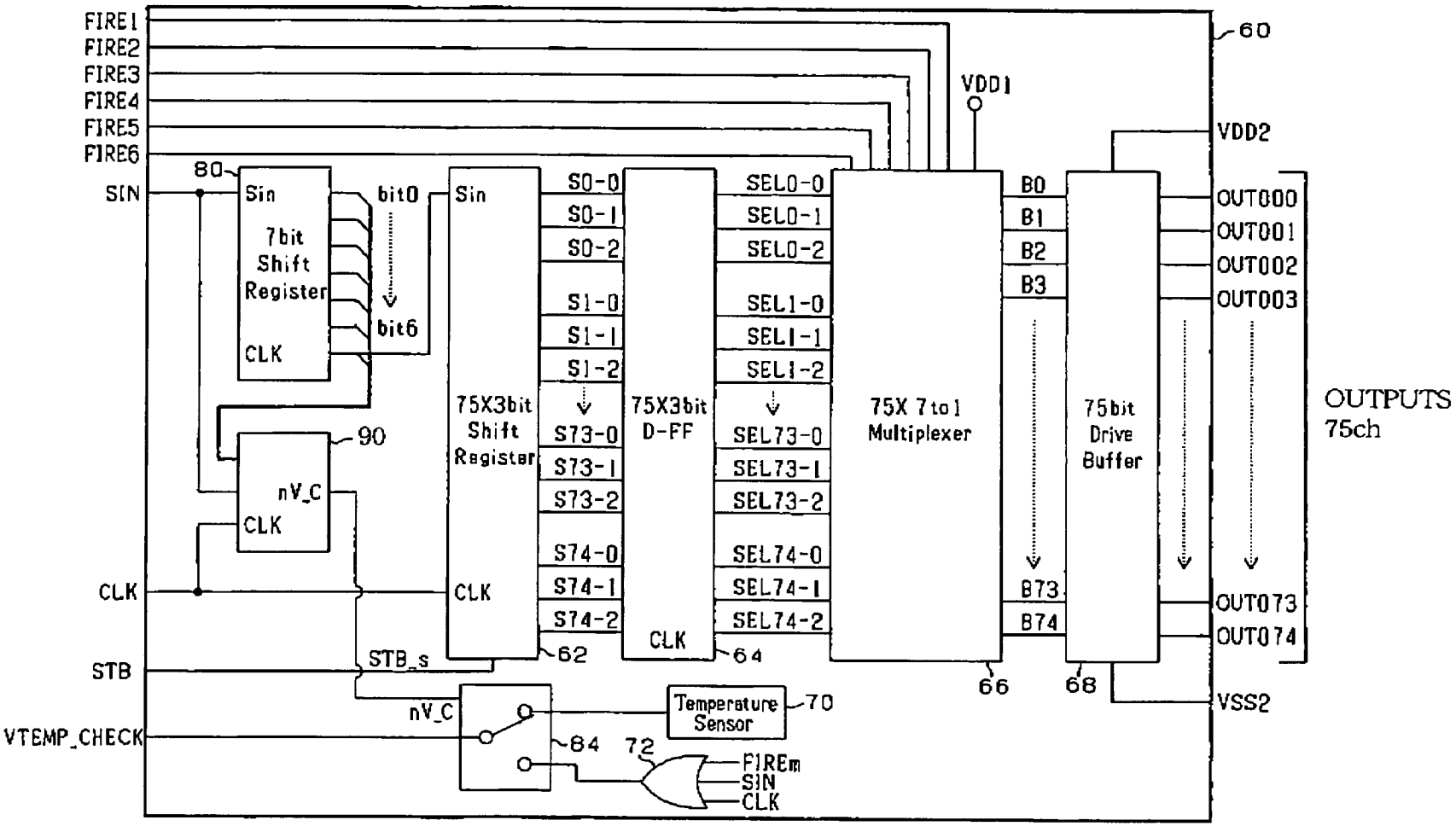
FIG. 12 is a circuit diagram of the driver IC according to a modification of the second embodiment.

FIG. 12 shows a circuit configuration of the driver IC 60 of the ink jet printer according to the second embodiment.

In FIG. 12, a structure of each of a 7-bit shift register 80, shift register 62, D flip-flop 64, multiplexer 66, and drive buffer 68 is identical with the corresponding element in the second embodiment, described above with reference to FIG. 9. However, a switching signal generating circuit 91 is provided instead of the strobe signal generating circuit 90. In the present modification of the second embodiment, similarly to the modification of the first embodiment as described with reference to FIG. 8, there is provided a switch 84 for selecting one of outputs from the temperature sensor 70 and from the performance-testing-signal transmitting portion 72. The switch 84 is configured such that the operating state thereof is switched based on an output (namely, switching signal nV_C) from the switching signal generating circuit 91. That is, when the print data SIN (11111) which is not assigned to select any of the waveform or non-ejection signals is inputted, the level of the output from the 7-bit shift register 80 is high, and the switching signal nV_C is outputted from the switching signal generating circuit 91 to the switch 84 which switches between an output from the temperature sensor 70 and that from the performance-testing-signal transmitting portion 72, based on either of which the switch 84 outputs a signal.

In the modification of the second embodiment, it is arranged such that the print data SIN(11111) which is not assigned to select any of the waveform or non-ejection signals is applied to the switch 84 to have the switch 84 output the output from the performance-testing-signal transmitting portion 72 to the circuit board 50 in the main body shown in FIG. 3. The strobe signal STB, the waveform signals FIRE1-FIRE6, print data SIN, clock signal CLK are sequentially applied to the driver circuit 60, so as to check whether these signals as the performance testing signal CHECK can be properly returned to the circuit board 50. Thus, an operation check, i.e., whether the flexible wiring board 52 is properly connected, and accordingly, whether the circuit board 50 and the driver IC 60 are properly connected to each other via the flexible wing board 52, is performed.

It is configured such that the switch 84 normally outputs the output of the temperature sensor 70 representing the temperature (i.e., a value of analog voltage corresponding to the temperature of the ink jet heads) to the circuit board 50 in the main body as shown in FIG. 3.

In the modification of the second embodiment, the selection between the outputs from the temperature sensor 70 and the performance-testing-signal transmitting portion 72 is made based on a predetermined one of the combinations of the values of plural bits of the print data, which is not assigned to select any of the waveform or non-ejection signals, namely, SIN(11111), Similarly to the modification of the first embodiment, this arrangement enables to switch between a plurality of sources of respective pieces of information, namely, between the temperature sensor 70 and the performance-testing-signal transmitting portion 72, based on the print data signal. Since an output signal line for the signal representing the temperature and an output signal line for the performance testing signal can be integrated into a single signal line, it is made possible to omit from the flexible wiring board 52 the signal line for transmitting performance testing information, which is not necessary during the printer is actually used. The omission of the signal line for transmitting the performance testing information from the flexible wiring board 52 decreases the number of the signal lines in the flexible wiring board 52, or the width of the flexible wiring board 52, thereby reducing the possibility of an occurrence of a disconnection even when an undesirable physical force is applied onto the flexible wiring board 52. Thus, the reliability is improved. Further, the number of pins connected to the flexible wiring board 52 decreases, widening the pitch of the connector, for instance, and thereby simplifying the structure. Still further, since the number of core wires of the flexible printed circuit board (FPC) or the flexible flat cable (FFC) is decreased, the manufacturing cost of the ink jet printer can be reduced.

Third Embodiment

There will be now described an ink jet printer according to a third embodiment of the invention. A structure of the ink jet printer of the third embodiment is identical with that of the first embodiment as described above with reference to FIGS. 1-3, except the circuit configuration of the driver IC 60. Therefore, only description of the circuit configuration is provided.

Figure 13:
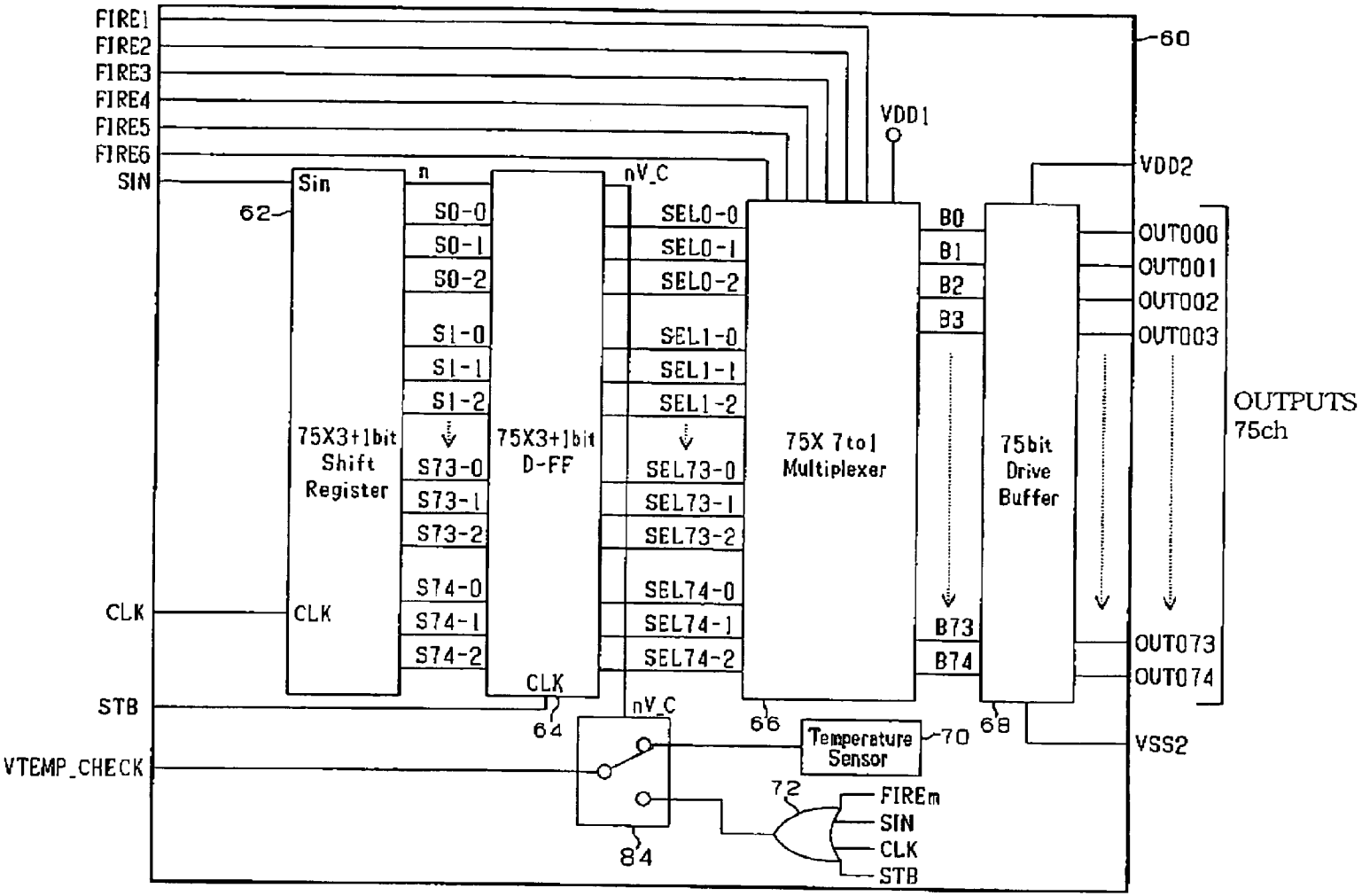
FIG. 13 is a circuit diagram of a driver IC according to a third embodiment.

FIG. 13 shows a circuit configuration of the driver IC 60 according to the third embodiment. A configuration of the driver IC 60 of the third embodiment is basically identical with that in the modification of the second embodiment as described above with reference to FIG. 12, except the following point. That is, in the modification of the second embodiment the switch 84 for selecting one of the outputs from temperature sensor 70 and from the performance-testing-signal transmitting portion 72 is switched in its operating state depending upon the output from the switching signal generating circuit 91. However, in the third embodiment the output from the shift register 62 is applied to the switch 84 via the D flip-flop 64, as a switching signal nV_C, so as to select one of the outputs from the temperature sensor 70 and from the performance-testing-signal transmitting portion 72. The shift register 62 has a terminal n for controlling the switching signal nV_C.

Figure 14:
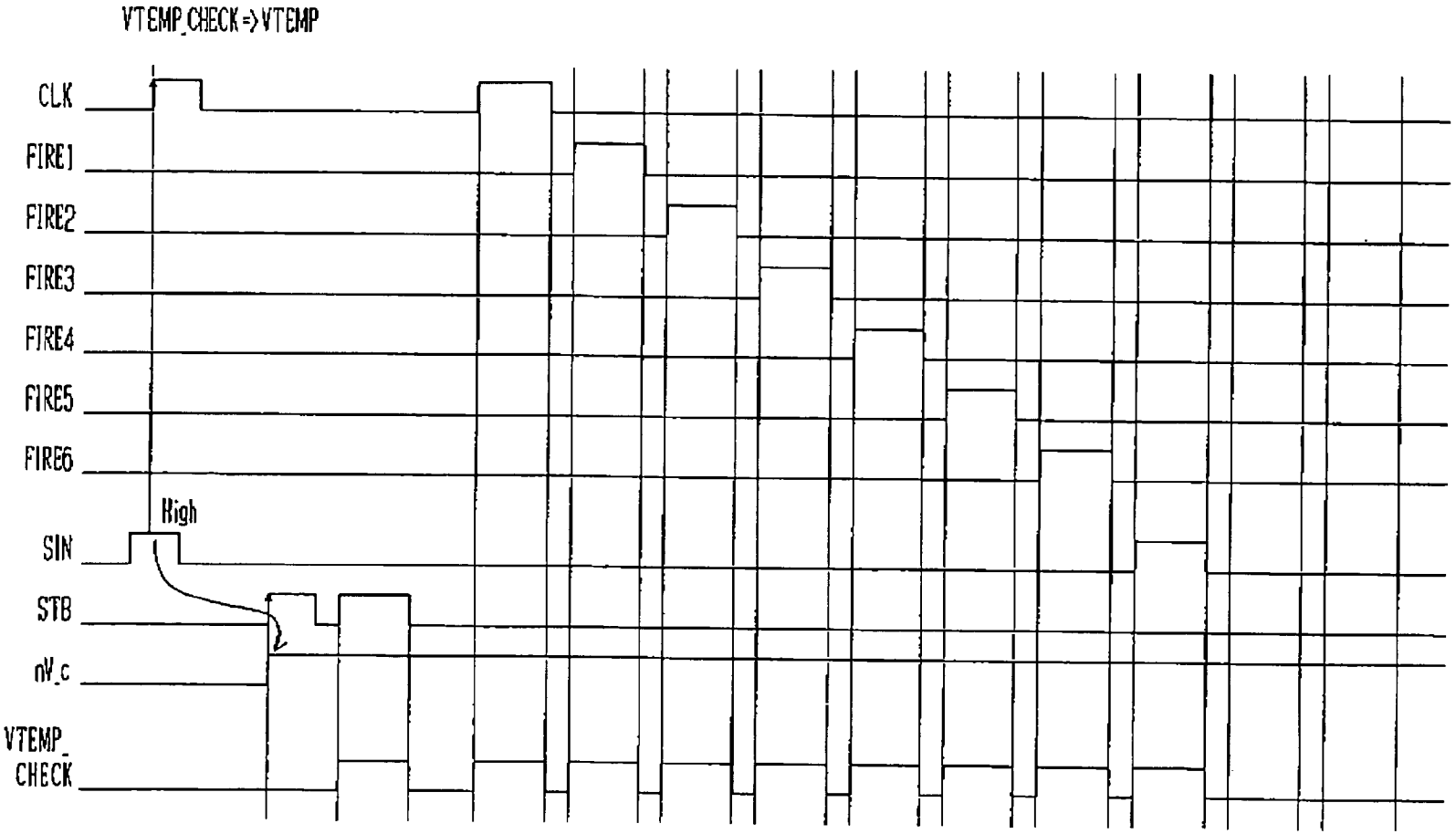
FIG. 14 is a timing chart illustrating signals treated in the driver IC of the third embodiment, and showing a state where a signal from a performance-testing-signal transmitting portion is selected to be transmitted, in accordance with print data.
Figure 15:
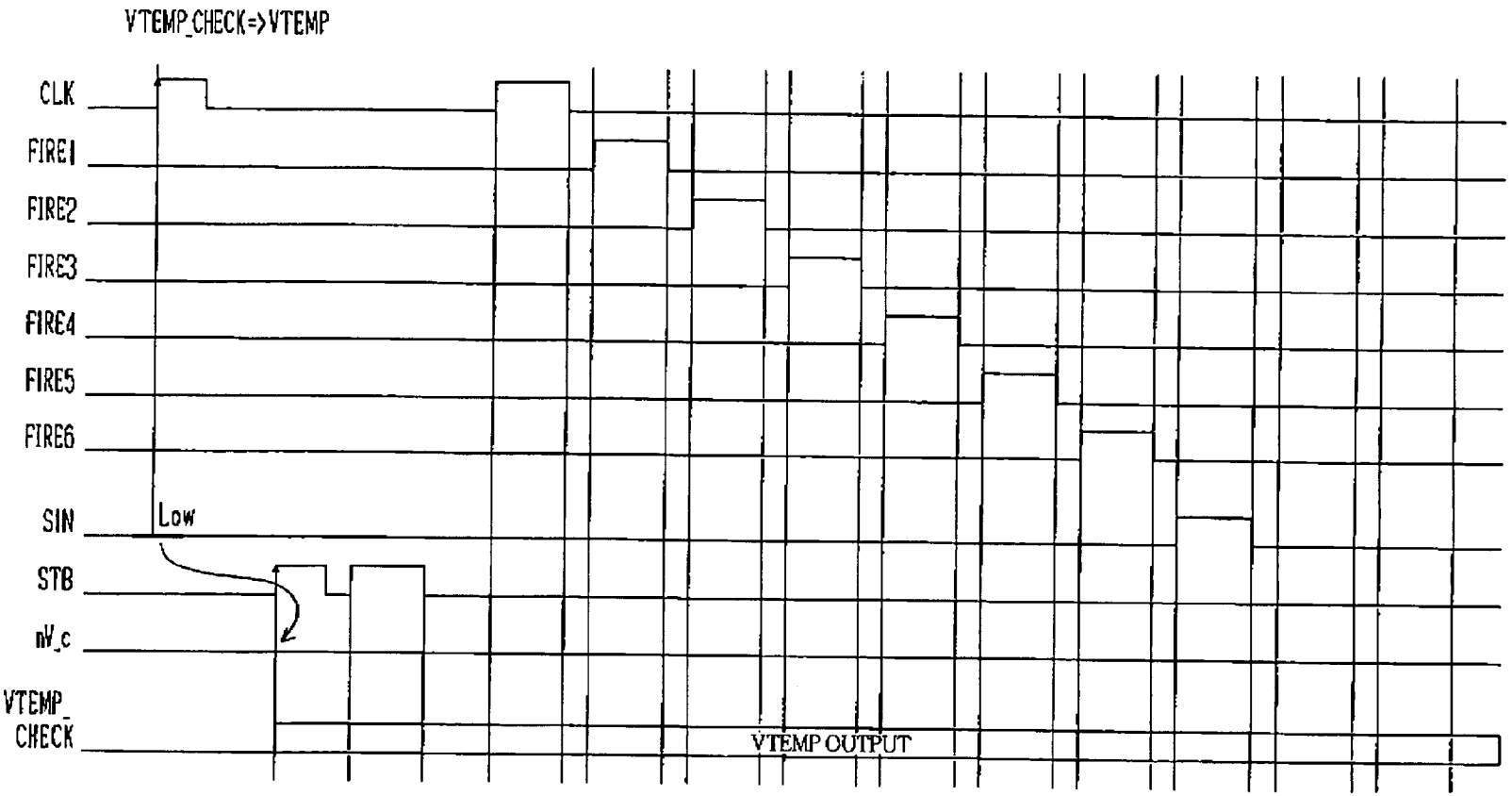
FIG. 15 is a timing chart illustrating signals handled in the driver IC of the third embodiment, and showing a state where a signal from a temperature sensor is selected in accordance with print data.
Figure 16:
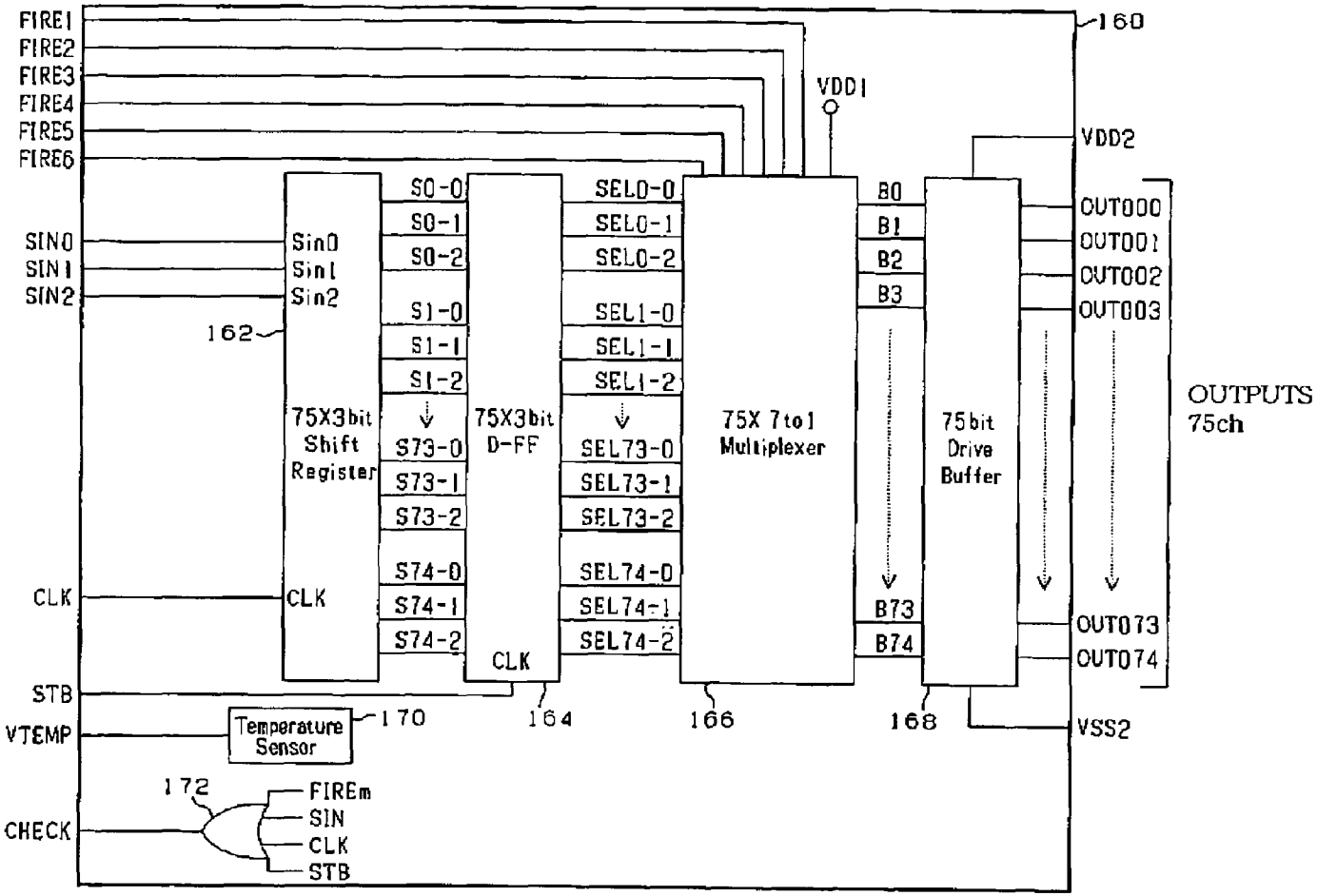
FIG. 16 is a circuit diagram of a driver IC of the related art.
Figure 17:
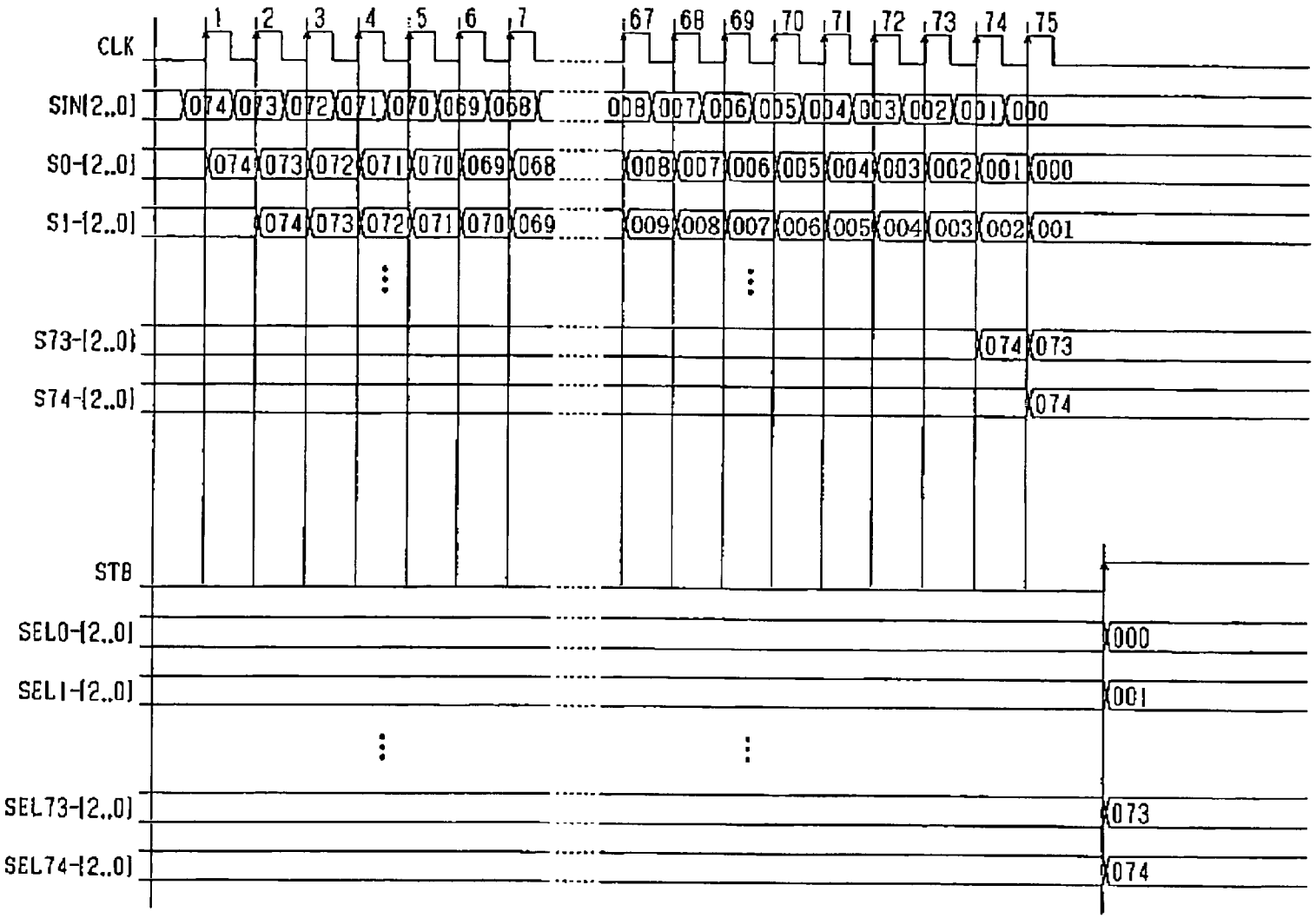
FIG. 17 is a timing chart illustrating signals treated in the driver IC of the related art shown in FIG. 16.

FIG. 14 is a timing chart illustrating signals treated in the driver IC of the third embodiment, in the case where the signal from the performance-testing-signal transmitting portion is selected based on the print data, while FIG. 15 shows the case where the signal from the temperature sensor is selected based on the print data. As shown in FIG. 14, when a bit of value 1 (high level) is added before a bit of the print data which corresponds to a parallel print signal S0-0 (that is, after a parallel print signal S74-2), the output from the terminal n of the shift register 62 is at the high level, and is applied to the D flip-flop 64. At the timing of the application of the strobe signal to the D flip-flop 64, the level of the switching signal nV_C becomes high, and accordingly the switch 84 selects the output from the performance-testing-signal transmitting portion 72. Thereafter, the strobe signal STB, clock signal CLK, waveform signals FIRE-FIRE6, and print data SIN are sequentially applied to the driver IC 60, so as to check whether these signals are properly returned to the circuit board 50 in the main body, as a performance testing signal VTEMP_CHECK. Thus, an operation check, i.e., whether the flexible wiring board 52 is properly connected, and accordingly, whether the circuit board 50 and the driver IC 60 are properly connected to each other via the flexible wiring board 52, is performed.

Then, as shown in FIG. 15, a bit of value 0 (low level) is added before a bit of the print data which corresponds to a parallel print signal S0-0 (that is, after a parallel print signal S74-2), the output from the terminal n of the shift register 62 is at the low level, and the output is applied to the D flip-flop 64. In this state, even when the strobe signal STB is applied to the D flip-flop 64, the switching signal nV_C continues to be at the low level, and accordingly, the switch 84 outputs the output from the temperature sensor 70 representing the temperature, i.e., a value of analog voltage corresponding to the temperature of the ink jet head, to the circuit board 50 in the main body as shown in FIG. 3.

In the third embodiment, one of the outputs from the temperature sensor 70 and the performance-testing-signal transmitting portion 72 is selected based on the one bit added at the head (or the last) of the print data. Similarly to the modifications of the first and second embodiments, this arrangement enables to switch between a plurality of sources of respective pieces of information, based on the print data signal. Since an output signal line for the signal representing the temperature and that for the performance testing signal can be integrated into a single output signal line, it is made possible to omit from the flexible wiring board 52 the signal line for transmitting performance testing information, which is not necessary during the printer is actually used. The omission of the signal line for transmitting the performance testing information from the flexible wiring board 52 decreases the number of the signal lines in the flexible wiring board 52, or the width of the flexible wiring board 52, thereby reducing the possibility of an occurrence of a disconnection even when an undesirable physical force is applied onto the flexible wiring board 52. Thus, the reliability is improved. Further, the number of pins connected to the flexible wiring board 52 decreases, widening the pitch of the connector, for instance, and thereby simplifying the structure. Still further, the reduction in the number of core wires of the flexible printed circuit board (FPC) or the flexible flat cable (FFC) can reduce the manufacturing cost of the ink jet printer.

INDUSTRIAL APPLICABILITY

In each of the above-described embodiments, the waveform signals FIRE1-FIRE6 are supplied from the circuit board in the main body. However, the invention is also applicable to an arrangement where the waveform signals are generated in the driver IC 60. Further, although the print data in each of the above-described embodiments is of three bits, the principle of the invention is applicable to a case where the print data is of two bits or four or more bits.

What is claimed is:

1. A drive circuit of a driver device for a recording head of a recording apparatus which has a main body connected, via a signal cable, to the drive circuit that is movable together with the recording head relative to the main body, such that the drive circuit receives a print data signal from the main body through the signal cable, so as to drive each of a plurality of recording elements of the recording head in accordance with the print data signal, comprising:

the print data signal including a selecting signal for selecting one of a plurality of waveform signals representing respective recording modes, and a non-selecting signal, such that both of the selecting signal and the non-selecting signal are transmitted to the drive circuit through at least one print-data signal line included in the signal cable, each of the at least one print-data signal line being common to the selecting signal and the non-selecting signal;

an outputting portion which outputs the selecting signal included in the print data signal, with the selecting signal associated with the corresponding recording element; and a non-selecting signal utilizing portion which uses the non-selecting signal for a purpose other than the selection of one of the waveform signals.

2. The drive circuit of claim 1, further comprising a waveform selecting portion which selectively outputs the waveform signal to each recording element, wherein the print data signal comprises at least one serial data signal, wherein the selecting signal designates one of the waveform signals by one of a plurality of combinations of plural bits, such that each of the plural bits is from a respective one of a plurality of serial data signals where the at least one serial data signal consists of the plurality of serial data signals, and such that the plural bits are of a single serial data signal where the at least one serial data signal consists of the single serial data signal, wherein the outputting portion outputs the selecting signal into the waveform selecting portion, wherein the waveform selecting portion outputs, to each corresponding recording element, the waveform signal designated by the combination of plural bits of the selecting signal outputted from the outputting portion, and wherein the non-selecting signal utilizing portion uses, as the non-selecting signal, at least one of the combinations of plural bits which is not used for the selection of one of the waveform signals.

3. The drive circuit of claim 2, wherein the non-selecting signal utilizing portion comprises a signal generating portion which receives a predetermined one of the at least one of the combinations of plural bits which is not used for the selection of one of the waveform signals, and generates, based on the received predetermined combination, a strobe signal for allowing the outputting portion to output the selecting signal into the waveform selecting portion.

4. The drive circuit of claim 2, wherein the outputting portion receives the print data signal from the main body through the signal cable.

5. The drive circuit of claim 2, wherein the non-selecting signal utilizing portion comprises an information output portion which transmits information to the main body, based on a predetermined one of the at least one of the combinations of plural bits which is not used for the selection of one of the waveform signals.

6. The drive circuit of claim 5, wherein the information output portion selectively transmits one of a plurality of pieces of information based on the predetermined one of the at least one of the combinations.

7. The drive circuit of claim 6, wherein the information output portion is normally held in a state for transmitting to the main body first information included in the plurality of pieces of information, and selectively transmits to the main body second information included in the plural pieces of information, based on the predetermined combination.

8. The drive circuit of claim 7, wherein the first information indicates a temperature of the recording head, while the second information is performance testing information for testing an operation of the driver device of the recording head.

9. The drive circuit of claim 2, wherein the print data signal comprises a single serial data signal, and the selecting signal designates one of the waveform signals by one of a plurality of combinations of plural bits of the single serial data signal.

10. The drive circuit of claim 9, wherein the signal cable includes a single print-data signal line as the at least one print-data signal line, and the outputting portion receives the print data signal from the main body through the single print-data signal line of the signal cable and outputs the received print data signal to each of the recording elements, and wherein the non-selecting signal utilizing portion comprises an information output portion which selectively outputs information to the main body based on the non-selecting signal included in the print data signal transmitted through the single print-data signal line.

11. The drive circuit of claim 10, wherein the information consists of a plurality of pieces of information and the information output portion selectively transmits one of a plurality of pieces of information based on a predetermined one of at least one bit of the print data signal which is not used for the selection of one of the waveform signals.

12. The drive circuit of claim 11, wherein the information output portion is normally held in a state for transmitting to the main body first information included in the plurality of pieces of information, and selectively transmits to the main body second information included in the plural pieces of information, based on the predetermined one of the at least one bit.

13. The drive circuit of claim 12, wherein the first information indicates a temperature of the recording head, while the second information is performance testing information for testing an operation of the driver device of the recording head.

14. A drive circuit of a driver device for a recording head of a recording apparatus, which receives a print data signal so as to drive each of a plurality of recording elements of the recording head in accordance with the print data signal, comprising:

the print data signal including a selecting signal for selecting one of a plurality of waveform signals representing respective recording modes, and a non-selecting signal;

an outputting portion which outputs the selecting signal included in the print data signal, with the selecting signal associated with the corresponding recording element;

a non-selecting signal utilizing portion which uses the non-selecting signal for a purpose other than the selection of one of the waveform signals; and a waveform selecting portion which selectively outputs the waveform signal to each recording element, wherein the print data signal comprises a plurality of serial data signals, and the selecting signal designates one of the waveform signals by one of a plurality of combinations of plural bits each from a respective one of the serial data signals, wherein the outputting portion outputs the selecting signal into the waveform selecting portion, wherein the waveform selecting portion outputs, to each corresponding recording element, the waveform signal designated by the combination of plural bits of the selecting signal outputted from the outputting portion, and wherein the non-selecting signal utilizing portion uses, as the non-selecting signal, at least one of the combinations of plural bits which is not used for the selection of one of the waveform signals.

15. The drive circuit of claim 14, wherein the non-selecting signal utilizing portion comprises a signal generating portion which receives a predetermined one of the at least one of the combinations of plural bits which is not used for the selection of one of the waveform signals, and generates, based on the received predetermined combination, a strobe signal for allowing the outputting portion to output the selecting signal into the waveform selecting portion.

16. The drive circuit of claim 15, wherein the recording apparatus comprises a main body and a signal cable including at least one print-data signal line, and the outputting portion receives the print data signal from the main body through the signal cable.

17. The drive circuit of claim 16, wherein the non-selecting signal utilizing portion comprises an information output portion which transmits information to the main body, based on a predetermined one of the at least one of the combinations of plural bits which is not used for the selection of one of the waveform signals.

18. The drive circuit of claim 17, wherein the information output portion selectively transmits one of a plurality of pieces of information based on the predetermined one of the at least one of the combinations.

19. The drive circuit of claim 18, wherein the information output portion is normally held in a state for transmitting to the main body first information included in the plurality of pieces of information, and selectively transmits to the main body second information included in the plural pieces of information, based on the predetermined combination.

20. The drive circuit of claim 19, wherein the first information indicates a temperature of the recording head, while the second information is performance testing information for testing an operation of the driver device of the recording head.

21. The drive circuit of claim 14, wherein the recording apparatus comprises a main body and a signal cable including at least one print-data signal line, and the outputting portion receives the print data signal from the main body through the signal cable.

22. The drive circuit of claim 21, wherein the non-selecting signal utilizing portion comprises an information output portion which transmits information to the main body, based on a predetermined one of the at least one of the combinations of plural bits which is not used for the selection of one of the waveform signals.

23. The drive circuit of claim 22, wherein the information output portion selectively transmits one of a plurality of pieces of information based on the predetermined one of the at least one of the combinations.

24. The drive circuit of claim 23, wherein the information output portion is normally held in a state for transmitting to the main body first information included in the plurality of pieces of information, and selectively transmits to the main body second information included in the plural pieces of information, based on the predetermined combination.

25. The drive circuit of claim 24, wherein the first information indicates a temperature of the recording head, while the second information is performance testing information for testing an operation of the driver device of the recording head.

26. A drive circuit of a driver device for a recording head of a recording apparatus, which receives a print data signal so as to drive each of a plurality of recording elements of the recording head in accordance with the print data signal, comprising:

the print data signal including a selecting signal for selecting one of a plurality of waveform signals representing respective recording modes, and a non-selecting signal;

an outputting portion which outputs the selecting signal included in the print data signal, with the selecting signal associated with the corresponding recording element; and a non-selecting signal utilizing portion which uses the non-selecting signal for a purpose other than the selection of one of the waveform signals, wherein the print data signal comprises a single serial data signal, and the selecting signal designates one of the waveform signals by one of a plurality of combinations of plural bits of the single serial data signal, and wherein the non-selecting signal utilizing portion uses, as the non-selecting signal, at least one of the combinations of plural bits which is not used for the selection of one of the waveform signals.

27. The drive circuit of claim 26, wherein the recording apparatus comprises a main body to which the drive circuit is connected via a signal cable including a single print-data signal line, and the outputting portion receives the print data signal from the main body through the single print-data signal line of the signal cable and outputs the received print data signal to each recording elements, and wherein the non-selecting signal utilizing portion comprises an information output portion which selectively outputs information to the main body based on the non-selecting signal included in the print data signal transmitted through the single print-data signal line.

28. The drive circuit of claim 27, wherein the information consists of a plurality of pieces of information and the information output portion selectively transmits one of a plurality of pieces of information based on a predetermined one of at least one of combinations of plural bits of the print data signal which is not used for the selection of one of the waveform signals.

29. The drive circuit of claim 28, wherein the information output portion is normally held in a state for transmitting to the main body first information included in the plurality of pieces of information, and selectively transmits to the main body second information included in the plural pieces of information, based on the predetermined combination.

30. The drive circuit of claim 29, wherein the first information indicates a temperature of the recording head, while the second information is performance testing information for testing an operation of the driver device of the recording head.

* * * * *